US012076606B2

(12) United States Patent
Svenberg

(10) Patent No.: US 12,076,606 B2
(45) Date of Patent: Sep. 3, 2024

(54) ADJUSTABLE WEIGHT LIFTING DEVICE

(71) Applicant: Personality Gym AB, Huskvarna (SE)

(72) Inventor: Tomas Svenberg, Huskvarna (SE)

(73) Assignee: Personality Gym AB, Huskvarna (SE)

( * ) Notice: Subject to any disclaimer, the term of this patent is extended or adjusted under 35 U.S.C. 154(b) by 0 days.

(21) Appl. No.: 18/519,847

(22) Filed: Nov. 27, 2023

(65) Prior Publication Data

US 2024/0091581 A1 Mar. 21, 2024

Related U.S. Application Data

(60) Continuation of application No. 18/107,734, filed on Feb. 9, 2023, now Pat. No. 11,865,397, which is a division of application No. 17/772,605, filed as application No. PCT/EP2020/064878 on May 28, 2020, now Pat. No. 11,602,661.

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0728* (2013.01)

(58) Field of Classification Search
CPC ..... A63B 21/00065; A63B 21/0724; A63B 21/0726; A63B 21/0728; A63B 21/075; A63B 2071/065; A63B 2071/0658; A63B 2071/0694
See application file for complete search history.

(56) References Cited

U.S. PATENT DOCUMENTS 7,087,000 B1 * 8/2006 Walker ..... A63B 21/0728 482/106
7,137,932 B2 * 11/2006 Doudiet ..... A63B 21/075 482/107
7,377,885 B2 * 5/2008 Doudiet ..... A63B 21/0728 482/107
7,491,155 B2 * 2/2009 Fenelon ..... A63B 21/075 482/107
7,862,487 B2 * 1/2011 Olson ..... A63B 21/0728 482/98
8,529,415 B2 * 9/2013 Svenberg ..... A63B 21/075 482/106
8,715,143 B2 * 5/2014 Svenberg ..... A63B 21/0728 482/106
8,784,283 B2 * 7/2014 Svenberg ..... A63B 21/075 482/106
8,932,188 B2 * 1/2015 Svenberg ..... A63B 21/0728 482/106
9,452,312 B2 * 9/2016 Svenberg ..... A63B 21/0724
9,566,465 B2 * 2/2017 Svenberg ..... A63B 21/075
9,616,271 B2 * 4/2017 Svenberg ..... A63B 21/00065
9,643,042 B2 * 5/2017 Madden ..... A63B 21/063
(Continued)

*Primary Examiner* — Joshua Lee
(74) *Attorney, Agent, or Firm* — WRB-IP PLLC

(57) ABSTRACT

An adjustable weight lifting device (21) includes a tube (31), a pin (33) movably disposed inside the tube (31), the pin (33) comprising an external thread (35), and one or more driving knobs (51) extending radially inward relative to an inner wall of the tube (31) and engaging with the external thread. The external thread comprises at least one portion having a first helix angle and at least one portion having a second helix angle, the second helix angle being smaller than the first helix angle.

17 Claims, 24 Drawing Sheets

(56) References Cited

U.S. PATENT DOCUMENTS 9,669,252 B2 * 6/2017 Svenberg ..... A63B 21/072
9,889,331 B2 * 2/2018 Svenberg ..... A63B 21/072
9,974,994 B2 * 5/2018 Svenberg ..... A63B 21/075
10,092,790 B2 * 10/2018 Svenberg ..... A63B 21/00069
10,232,214 B2 * 3/2019 Svenberg ..... A63B 21/0728
10,232,216 B2 * 3/2019 Svenberg ..... A63B 21/00065
11,013,947 B2 * 5/2021 Svenberg ..... A63B 21/072
11,135,469 B2 * 10/2021 Svenberg ..... A63B 21/0728
2003/0096683 A1 * 5/2003 Fenelon ..... A63B 21/075
482/107
2009/0156376 A1 * 6/2009 Fenelon ..... A63B 21/075
482/108
2010/0304939 A1 * 12/2010 Svenberg ..... A63B 21/072
482/108
2010/0304940 A1 * 12/2010 Svenberg ..... A63B 21/075
482/108
2010/0323856 A1 * 12/2010 Svenberg ..... A63B 21/075
482/108
2013/0231224 A1 * 9/2013 Svenberg ..... A63B 21/072
482/107
2013/0324375 A1 * 12/2013 Svenberg ..... A63B 21/00069
482/108
2014/0206510 A1 * 7/2014 Svenberg ..... A63B 21/072
482/108
2014/0296041 A1 * 10/2014 Svenberg ..... A63B 21/00065
482/108
2015/0094194 A1 * 4/2015 Svenberg ..... A63B 21/0724
482/107
2016/0206339 A1 7/2016 Akilian et al.
2016/0367849 A1 * 12/2016 Svenberg ..... A63B 21/072
2017/0072244 A1 * 3/2017 Svenberg ..... A63B 21/075
2017/0072245 A1 * 3/2017 Svenberg ..... A63B 21/0728
2017/0239511 A1 * 8/2017 Svenberg ..... A63B 21/072
2018/0140889 A1 * 5/2018 Svenberg ..... A63B 21/0728
2018/0236296 A1 * 8/2018 Svenberg ..... A63B 21/00065
2019/0001177 A1 * 1/2019 Svenberg ..... A63B 21/00069
2019/0168058 A1 * 6/2019 Svenberg ..... A63B 21/072
2019/0168059 A1 * 6/2019 Svenberg ..... A63B 21/0728

* cited by examiner

ADJUSTABLE WEIGHT LIFTING DEVICE

The present application is a continuation of U.S. application Ser. No. 18/107,734, filed Feb. 9, 2023, which is a divisional of U.S. application Ser. No. 17/772,605, filed Apr. 28, 2022, now U.S. Pat. No. 11,602,661, issued Mar. 14, 2023, which was the U.S. national stage of International Application PCT/EP2020/064878, filed May 28, 2020, which are all incorporated by reference.

BACKGROUND AND SUMMARY

The present invention relates to an adjustable weight lifting device. My U.S. Pat. Nos. 8,206,274, 8,529,415, 8,715,143, 8,784,283, 8,932,188, 9,452,312, 9,566,465, 9,616,271, 9,669,252, 9,889,331, 9,974,994, 10,232,214, and U.S. patent application Ser. No. 15/861,069 show features of adjustable weight lifting devices and are incorporated by reference. A common feature of these adjustable weight lifting devices is that a handle assembly is seated in a rack and, upon rotation of a portion of the handle assembly relative to another portion of the handle assembly, pins can be extended from the handle assembly to lock weight disks to the handle assembly, or can be retracted from the weight disks to unlock weight disks from the handle assembly.

I have discovered that it is desirable to improve the manner in which weight disks are secured to a handle assembly in such adjustable weight lifting devices. It is, additionally, desirable to permit greater numbers of weight disks to be secured to a handle assembly. I have further discovered that it is desirable to provide a simple, inexpensive technique for indicating how much weight is being held on a handle assembly, and, further to permit indication of how much weight is being held on the handle assembly even though a rotating portion of the handle is rotated through more than 360 degrees.

According to an aspect of the present invention, an adjustable weight lifting device comprises a tube, a pin movably disposed inside the tube, the pin comprising an external thread, and one or more driving knobs extending radially inward relative to an inner wall of the tube and engaging with the external thread, wherein the external thread comprises at least one portion having a first helix angle and at least one portion having a second helix angle, the second helix angle being smaller than the first helix angle.

According to another aspect of the present invention, an adjustable weight lifting device, comprises a tube, a housing having an axially inner portion nonrotatably attached to the tube at a first end of the tube and an axially outer portion that is rotatable relative to the axially inner portion, the axially inner portion comprising an axially inner portion face gear facing the axially outer portion and the axially outer portion having an axially outer portion face gear facing the axially inner portion, an index ring comprising an exterior surface provided with indicia and an inner surface, and one or more gears or cogwheels mounted on the inner surface of the index ring for rotation about one or more corresponding radially extending axes, each radially extending axis being perpendicular to a longitudinal axis of the index ring and each gear or cogwheel meshing with the axially inner portion face gear and the axially outer portion face gear.

According to another aspect of the present invention, an adjustable weight lifting device, comprises a tube, a cylindrical member disposed in the tube, the tube and the cylindrical member being rotatable relative to each other and axially fixed relative to each other, a first housing having an axially inner portion nonrotatably attached to the tube at a first end of the tube and an axially outer portion nonrotatably attached to the cylindrical member at a first end of the cylindrical member, and a second housing having an axially inner portion nonrotatably attached to the tube at a second end of the tube and an axially outer portion nonrotatably attached to the cylindrical member at a second end of the cylindrical member.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
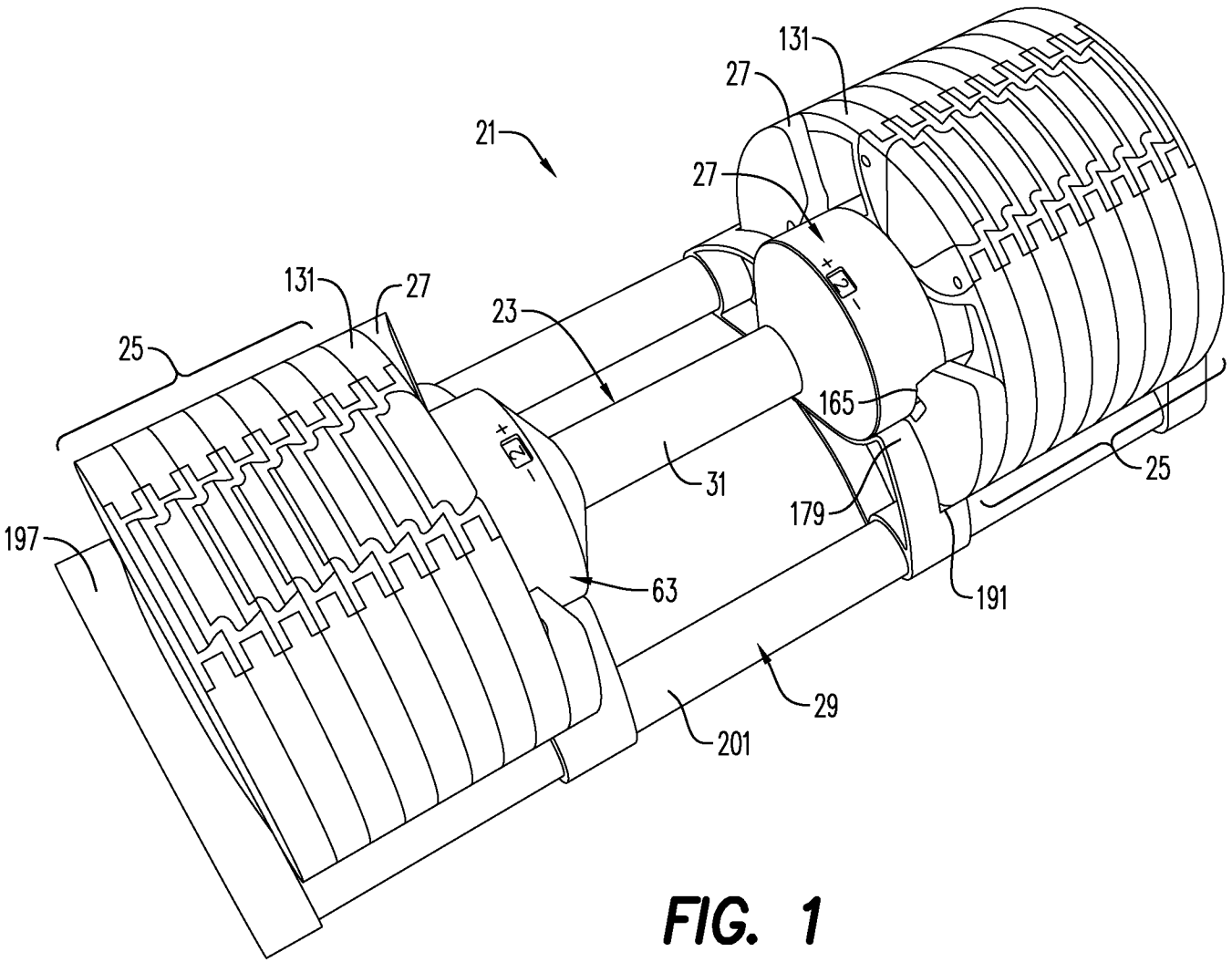
FIG. 1 is a perspective view of an adjustable weight lifting device according to an aspect of the present invention.

An adjustable weight lifting device 21 according to a presently preferred embodiment of the invention is shown in FIG. 1. The illustrated weight lifting device 21 is a dumbbell; however, the weight lifting device may alternatively be a device such as a barbell. The weight lifting device 21 includes a handle assembly 23, a plurality of weight disks 25 removably attachable to the handle assembly, a pair of butterfly weight disks 27 removably attachable to the handle assembly, and a rack 29 in which the weight disks, butterfly weight disks, and handle assembly are adapted to be supported.

As seen in FIGS. 2*a-d*, the handle assembly 23 comprises a tube 31 that is intended for a user to grip as a handle. An exterior surface of the tube 31 is typically knurled for improved grip. A first pin 33 is movably disposed inside the tube 31 and comprises an external thread 35. A second pin 37 is also movably disposed inside the tube 31 and comprises an external thread 39. The first pin 33 has a first hand and the second pin 37 has a second hand opposite the first hand. As illustrated, the first pin 33 has a left-hand thread 35 and the second pin 37 has a right-hand thread 39. The external threads 35 and 39 can each comprise at least one portion 35' and 39', respectively, having a first helix angle and at least one portion 35" and 39", respectively, having a second helix angle, the second helix angle being smaller than the first helix angle. Ordinarily, there will be a plurality of such portions with different helix angles, with one thread portion with one helix angle succeeding another thread portion with the other helix angle repeating over the length of the external threads.

The first pin 33 and the second pin 37 each have a recess 41 along at least a majority of a length of each of the first pin and the second pin. A cylindrical member 45 is disposed in the recesses 41 of the first pin 33 and the second pin 37. The first pin 33 and the second pin 37 are ordinarily half-circular along the majority of the lengths of their exteriors, and the recesses 41 are also ordinarily half-circular and formed in a flat face 47 and 49, respectively, of the first pin and the second pin, respectively. The cylindrical member 45 is ordinarily circular or of any other suitable shape, typically matching a shape of the recesses 41.

One or more driving knobs 51 (e.g., FIG. 2*b*) extend radially inward relative to an inner wall of the tube 31 and engage with the external threads 35 and 39. Preferably, four driving knobs 51 are provided for engaging with external threads 35 on the first pin 33 and four driving knobs are provided for engaging with external threads 39 on the second pin 37. The driving knobs 51 can be attached to the tube 31 and may extend through holes 53 provided on the tube 31.

Figure 3:
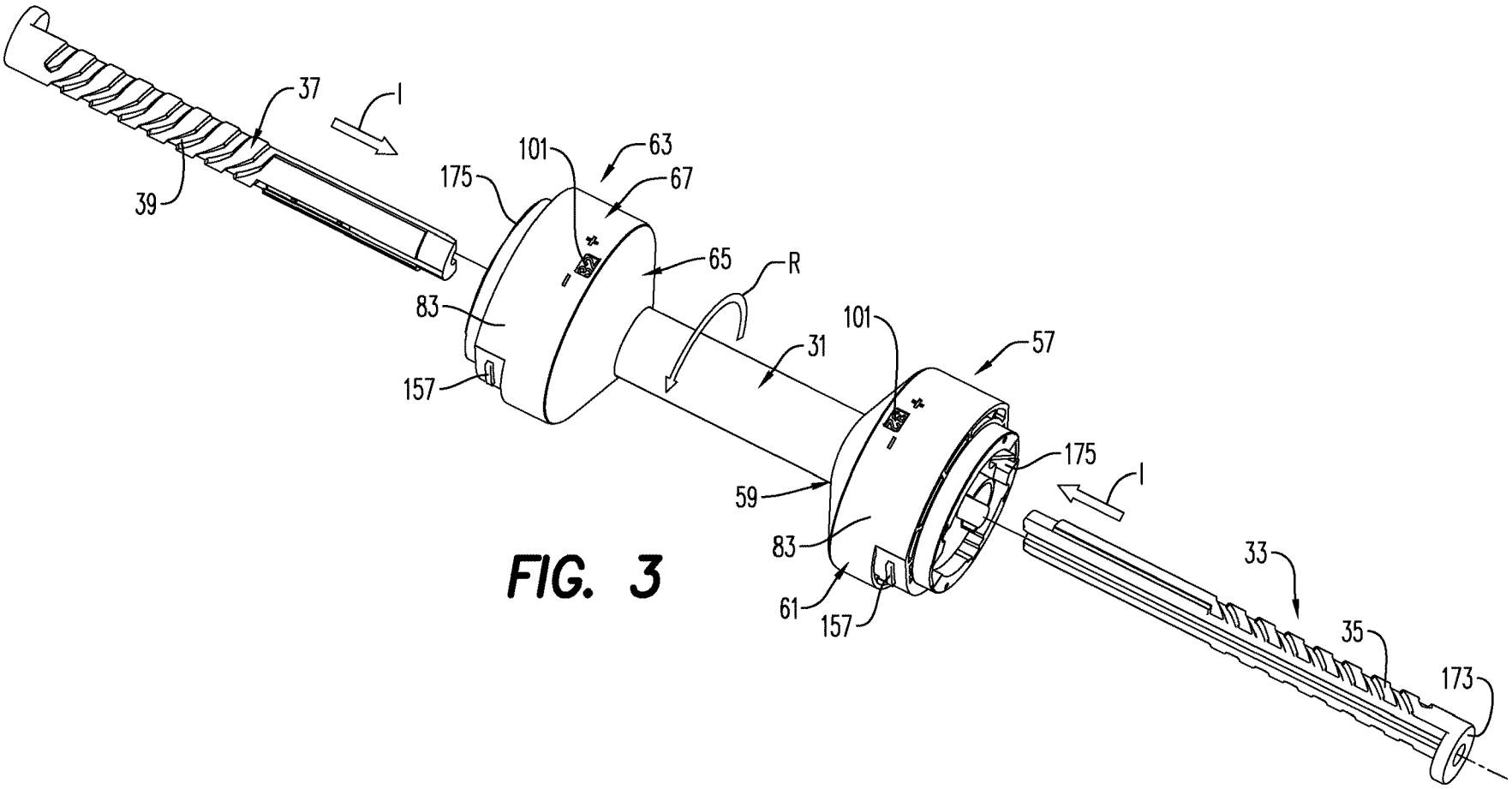
FIG. 3 is a perspective view of a portion of a handle assembly of an adjustable weight lifting device according to an aspect of the present invention.

As seen in FIG. 3, when the first pin 33 and the second pin 37 are prevented from rotation and the tube 31 with driving knobs 51 engaging in the external threads 35 and 39 of the first and second pin is rotated (e.g., as shown by the arrow R), the first pin and the second pin will be caused to move axially in opposite directions relative to each other and axially inward (as shown by arrows I) or outward relative to the tube and the driving knobs, depending upon the direction in which the tube is rotated. With reference to, e.g., FIG. 2*b*, while the driving knobs 51 will be generally circular in cross-section over much of their length, ends of the driving knobs that are to be received in the external threads 35 and 39 may be provided with a more elongated shape 51' that can be aligned with the threads in which the ends will be received. The elongated shape 51' can be oriented at a specific angle relative to a ridged head 51" of the driving knobs to facilitate orientation of the elongated shape.

Figure 4A:
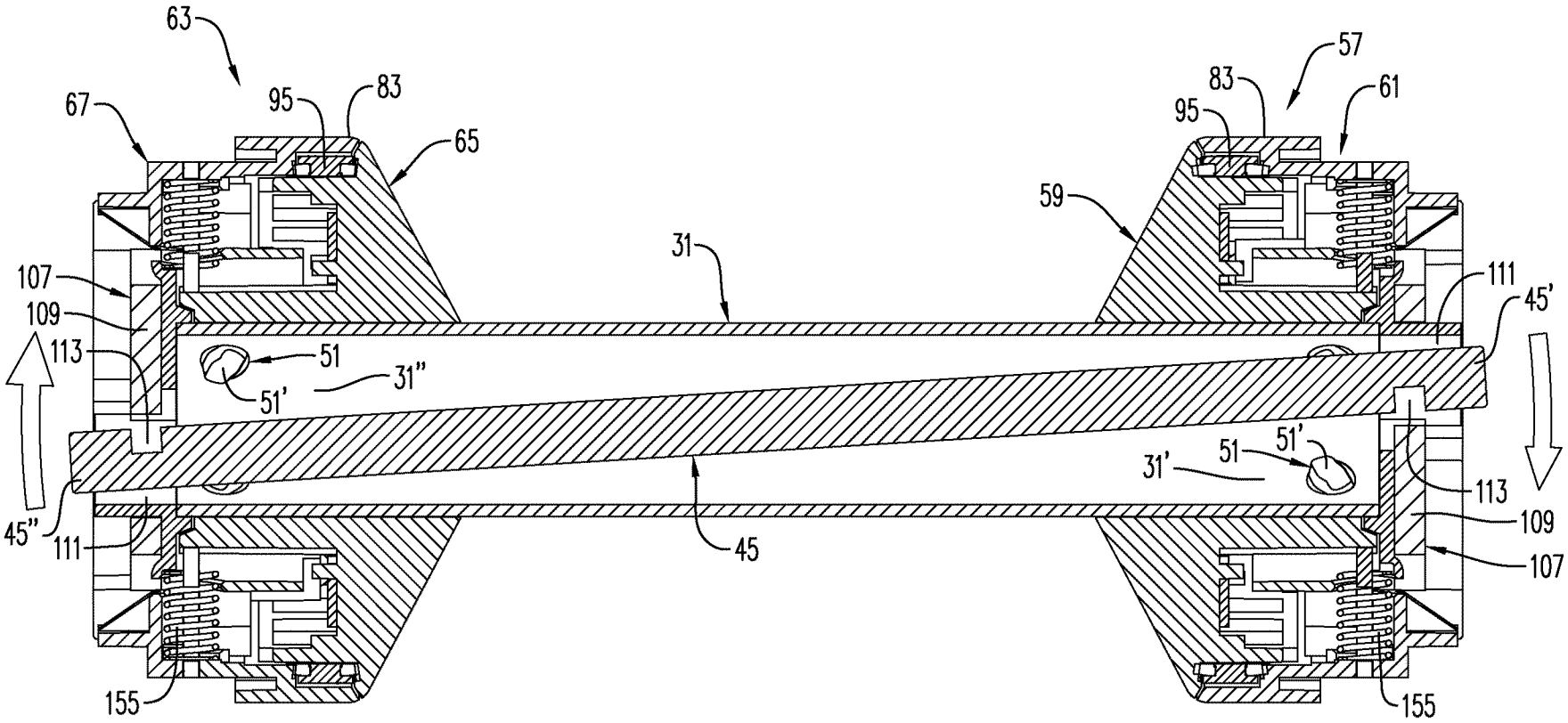
FIGS. 4A and 4B are cross-sectional side views of a portion of a handle assembly of an adjustable weight lifting device according to an aspect of the present invention showing attachment of a cylindrical member.
Figure 4B:
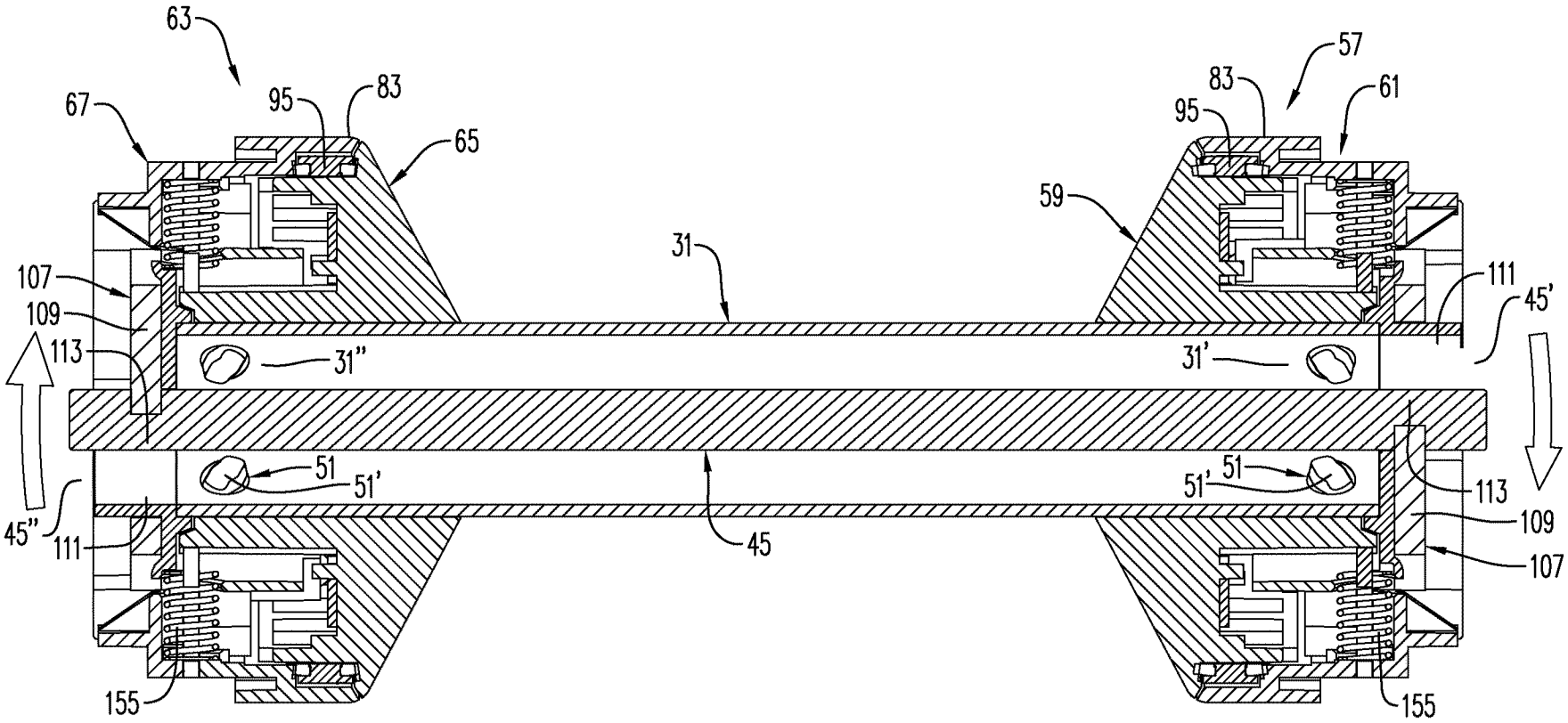

As seen, for example, in FIGS. 4A-4B, the handle assembly 23 further comprises a first housing 57 having an axially inner portion 59 nonrotatably attached to the tube 31 at a first end 31' of the tube and an axially outer portion 61 nonrotatably attached to the cylindrical member 45 at a first end 45' of the cylindrical member, and a second housing 63 having an axially inner portion 65 nonrotatably attached to the tube at a second end 31" of the tube and an axially outer portion 67 nonrotatably attached to the cylindrical member at a second end 45" of the cylindrical member. The axially inner portions 59 and 65 of the first and second housings 57 and 63, respectively, are rotatable relative to the axially outer portions 61 and 67 of the first and second housings, respectively.

As seen, for example, in FIGS. 5A-5F, a cam knob 69 is provided as part of each of the axially inner portions 59 and 65. The cam knob 69 can be attached to and rotatable with the axially inner portion 59 or 65 (and at least partially disposed inside the axially outer portion 61 or 67, as seen with reference to, e.g., FIGS. 5F-5I), such as by forming the cam knob as an integral part of the axially inner portion, such as part of a molded plastic part. The axially outer portions 61 and 67 can also be molded plastic parts. The cam knob 69 has an exterior surface 71 that varies between a first distance D1 (FIG. 5A) from an axial center of the tube 31 and a second distance D2 (FIG. 5A) from the axial center of the tube, the second distance being greater than the first distance.

Figure 5A:
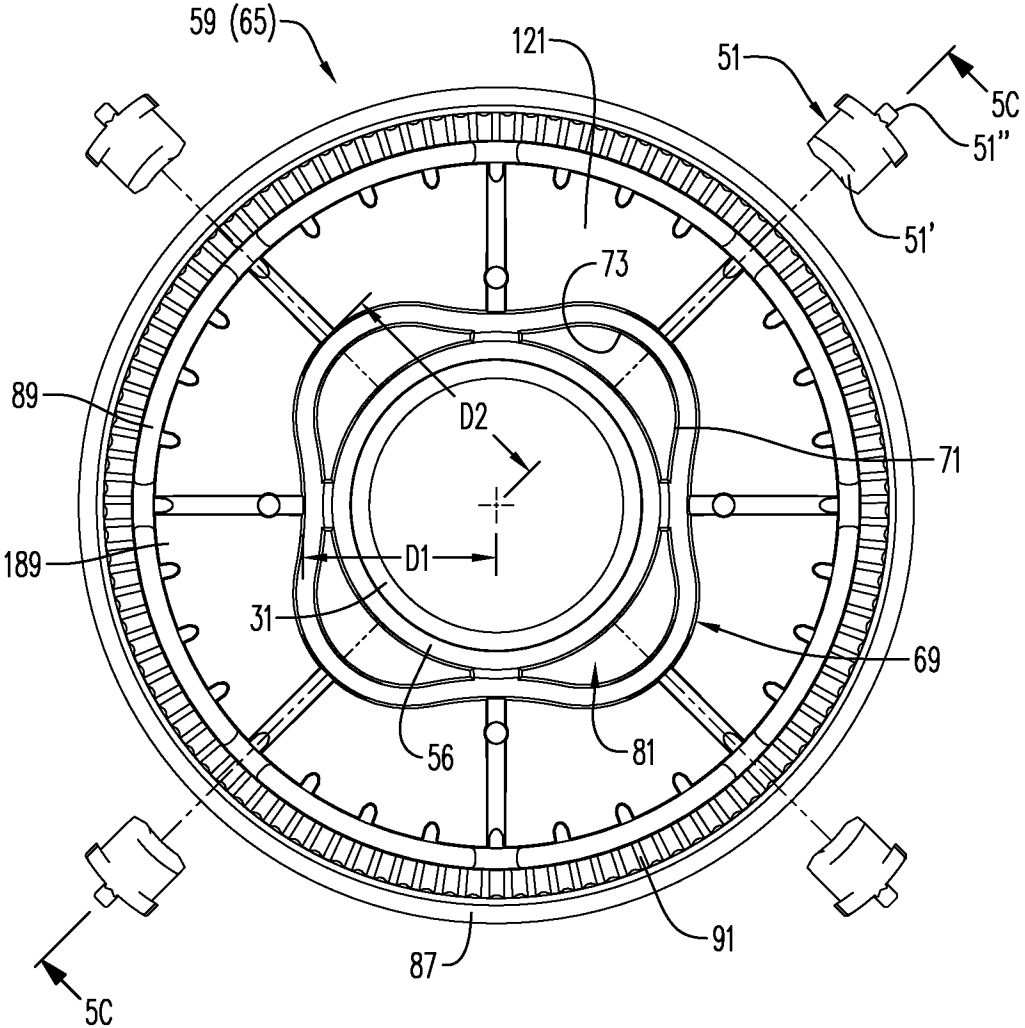
FIG. 5A is an end view.
Figure 5B:
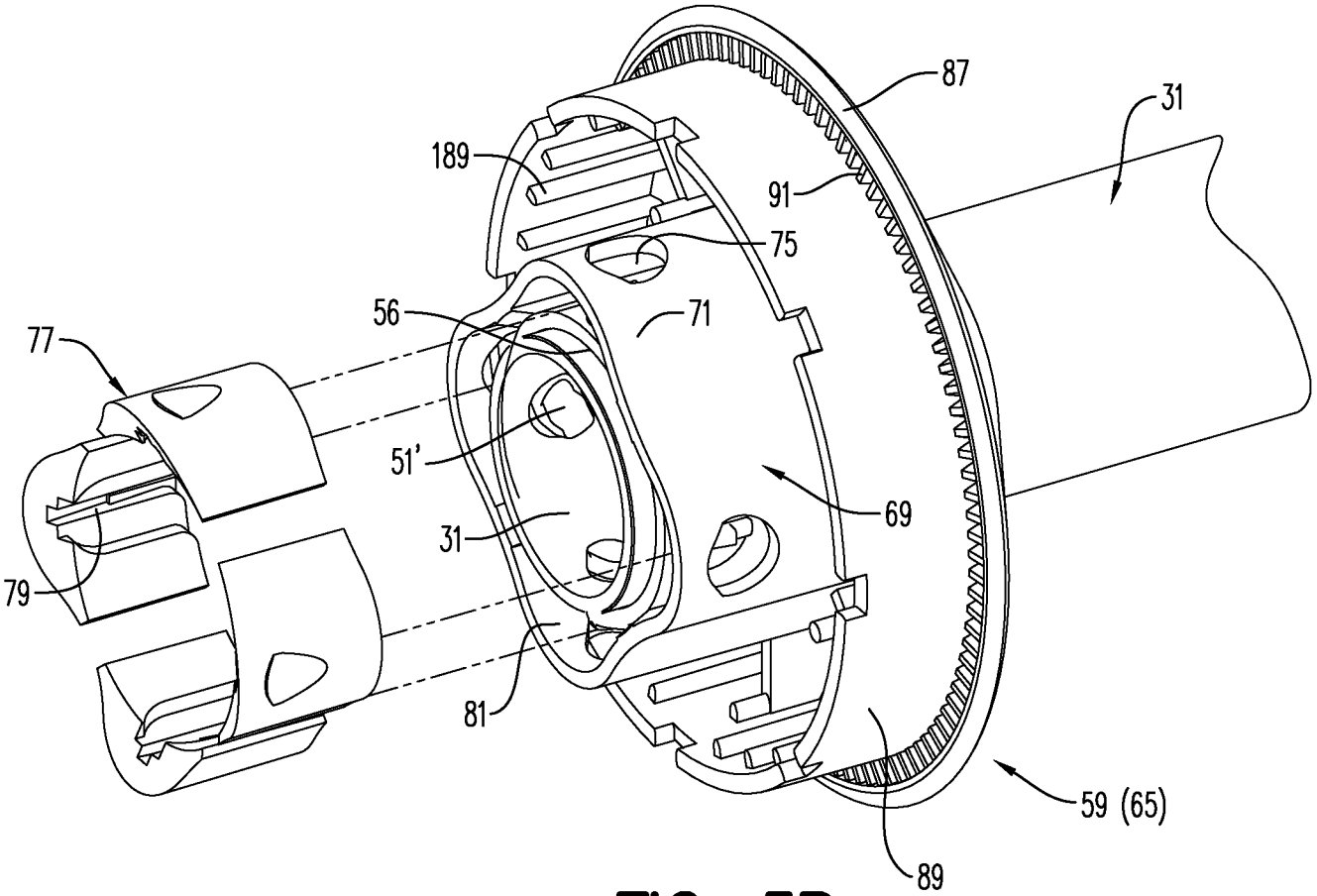
FIG. 5B is a partially exploded perspective view.
Figure 5C:
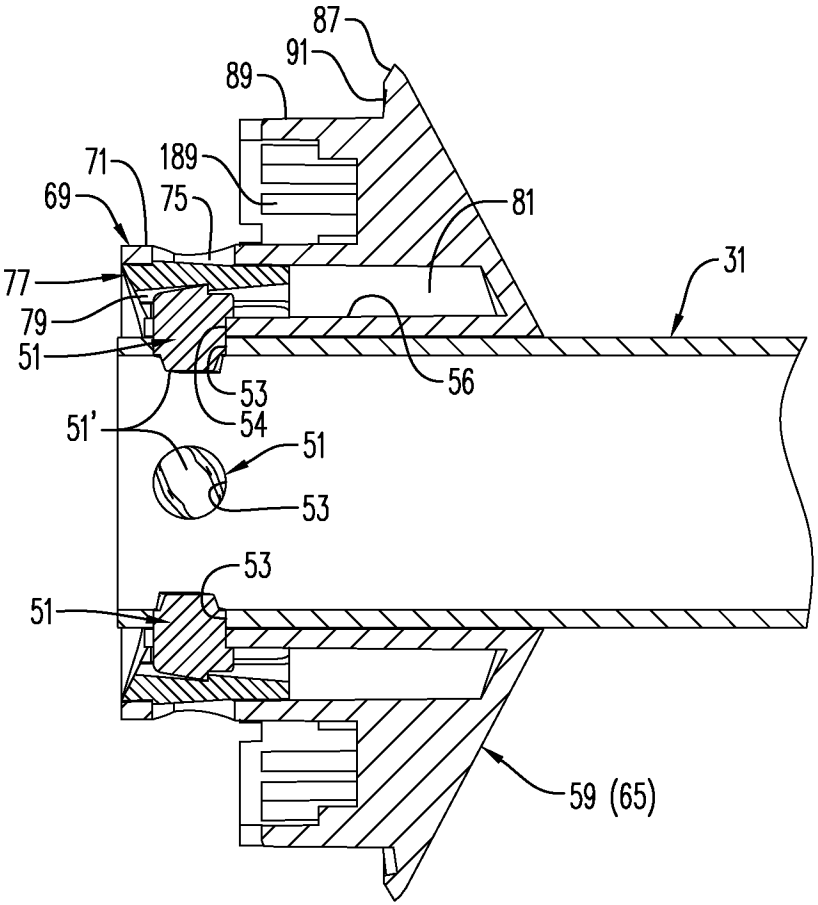
FIG. 5C is a side cross-sectional view of view of an axially inner portion of a handle assembly housing of an adjustable weight lifting device according to an aspect of the present invention.

As seen in FIGS. 5A-5C, the axially inner portions 59 and 65 can be nonrotatably secured to the tube 31 by attaching the driving knobs 51 in the holes 53 (FIGS. 2*a* and 5C) of the tube and in holes 54 (FIG. 5C) in a cylindrical portion 56 of the axially inner portions through which the end of the tube extends. The cam knob 69 is positioned over the driving knobs so that the driving knobs are disposed beneath an interior surface 73 of the cam knob corresponding to the portions of the exterior surface 71 at the greater distance D2 from the axial center of the tube. The cam knob 69 may have holes 75 through which the driving knobs 51 can be passed in order to secure the driving knobs in the holes 53 of the tube 31. Driving knob brackets 77 (FIGS. 5B-5C) having recesses 79 for receiving ridged heads 51" of the driving knobs 51 can be shaped to form a tight fit in spaces 81 (e.g., FIG. 5B) formed between the cylindrical portion 56 and the interior surface 73 of the cam knob 69 to facilitate holding the driving knobs 51 in a correct angular position with elongated ends of the driving knobs positioned to slide along the threads 35 and 39.

As seen, for example, with reference to FIG. 5F-5I, the axially outer portions 61 and 67 of the first and second housings 57 and 63 each comprise a circularly cylindrical tubular portion 83 having an axially inwardly facing end 85 that abuts against an axially outwardly facing flange 87 on the axially inner portions 59 and 65 and surrounds a circularly cylindrical portion 89 of the axially inner portions.

In the illustrated embodiment, each axially inner portion 59 and 65 comprises an axially inner portion face gear 91 radially inwardly of the outwardly facing flange 87. The axially outer portions 51 and 67 each have an axially outer portion face gear 93 (FIGS. 5H and 6A-6C) radially inwardly of the tubular portion 83 and facing a respective axially inner portion face gear 91 on a respective axially inner portion 59 and 65.

Figure 5D:
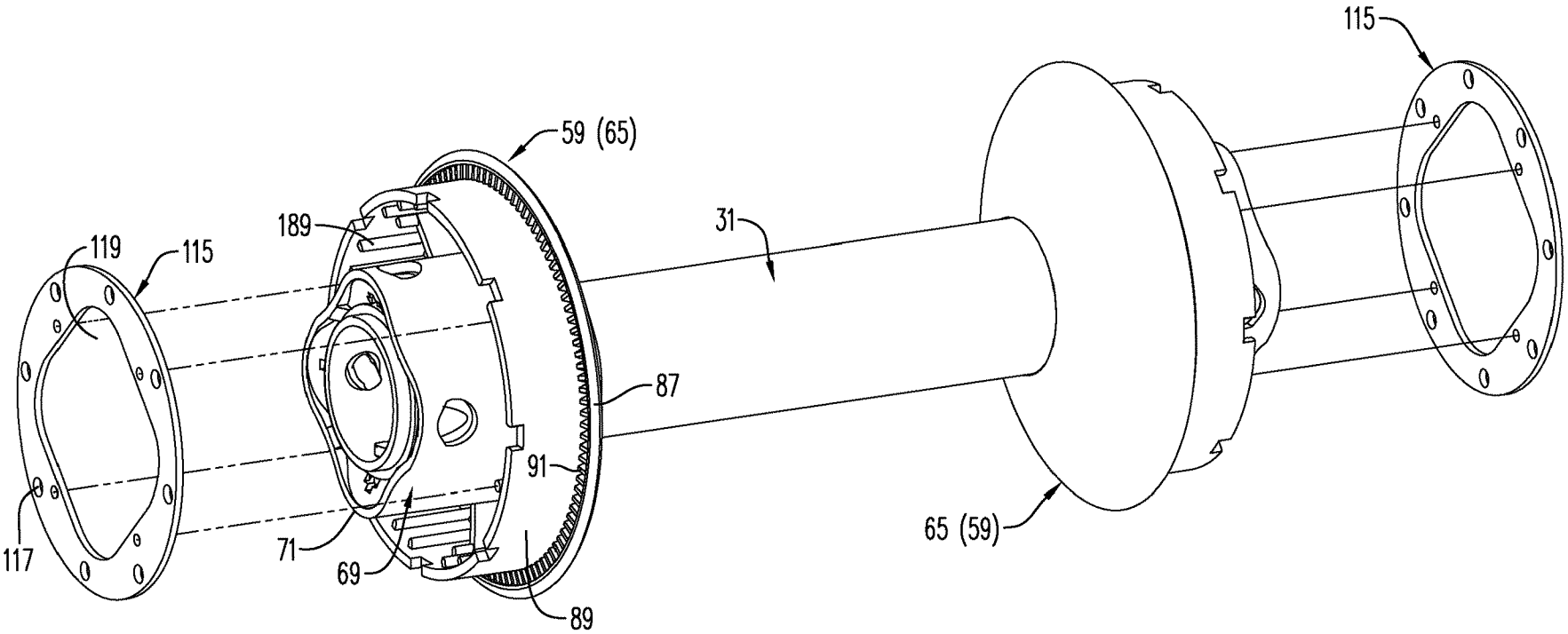
FIG. 5D is a partially exploded perspective view of a portion of a handle assembly including a click plate of an adjustable weight lifting device according to an aspect of the present invention.
Figure 5E:
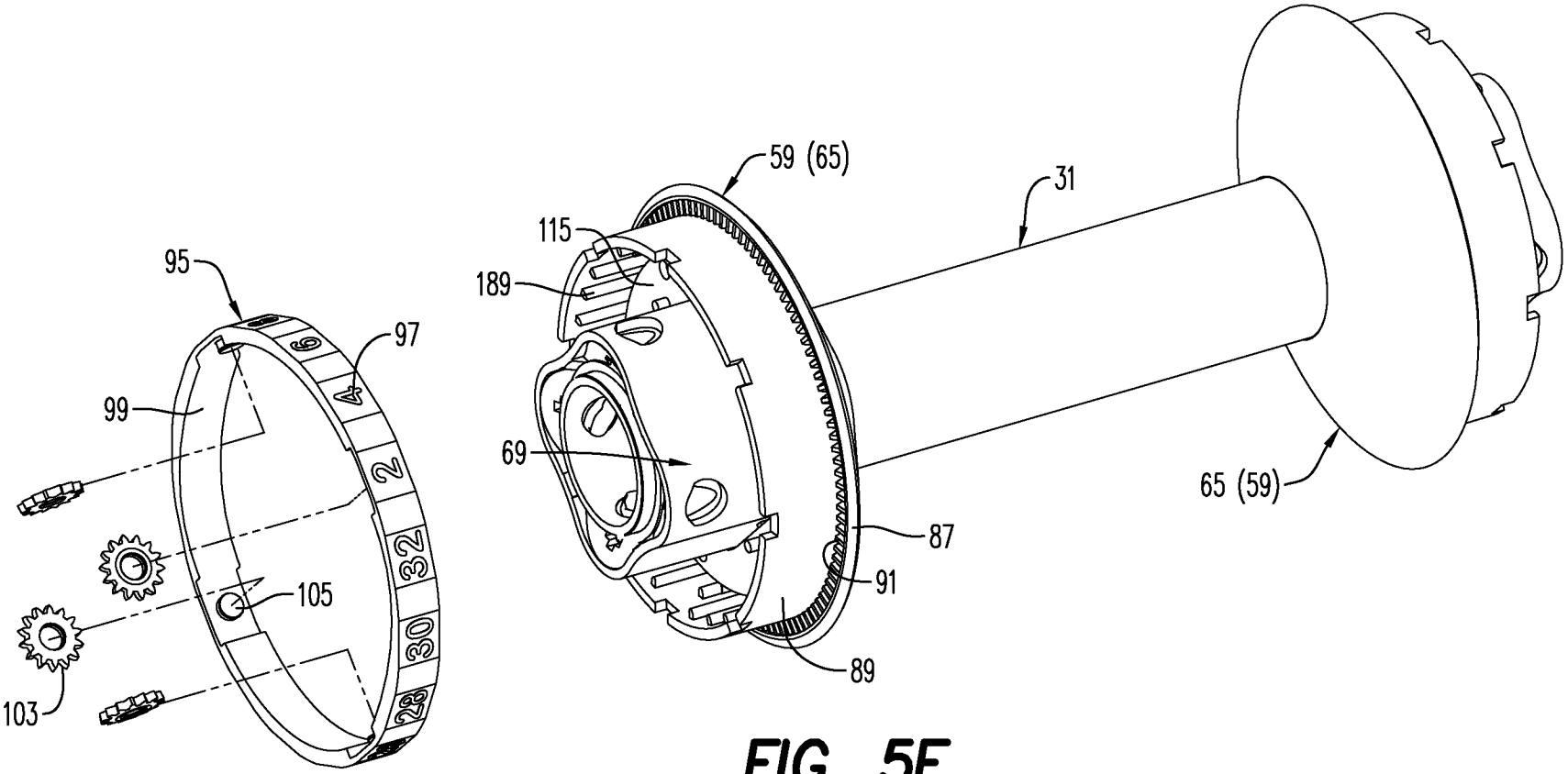
FIG. 5E is a partially exploded perspective view of a portion of a handle assembly including an index ring of an adjustable weight lifting device according to an aspect of the present invention.
Figure 5F:
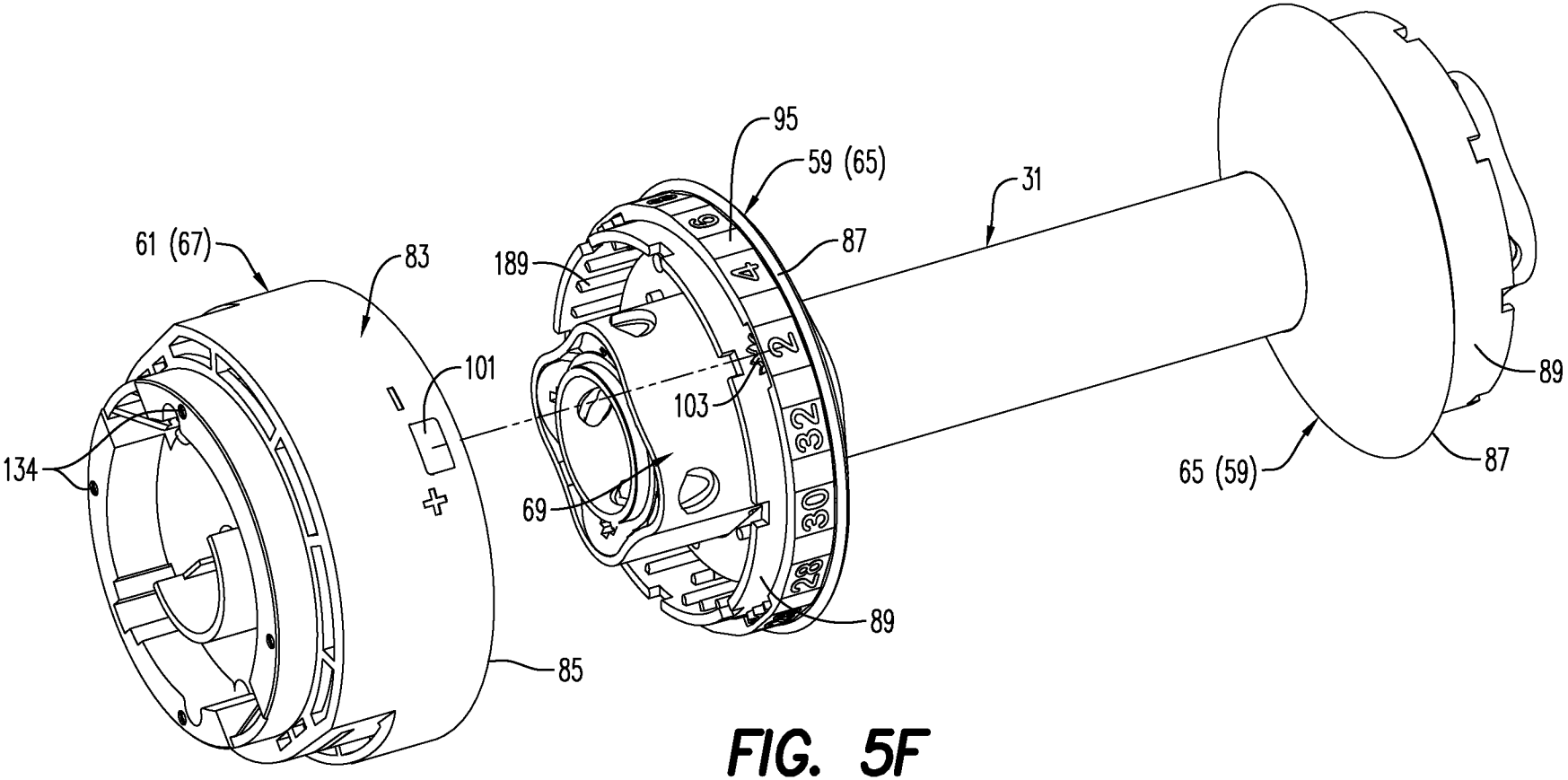
FIG. 5F is a partially exploded perspective view and FIG. 5G is an assembled view of a portion of a handle assembly including axially inner and axially outer portions of an adjustable weight lifting device according to an aspect of the present invention.
Figure 5G:
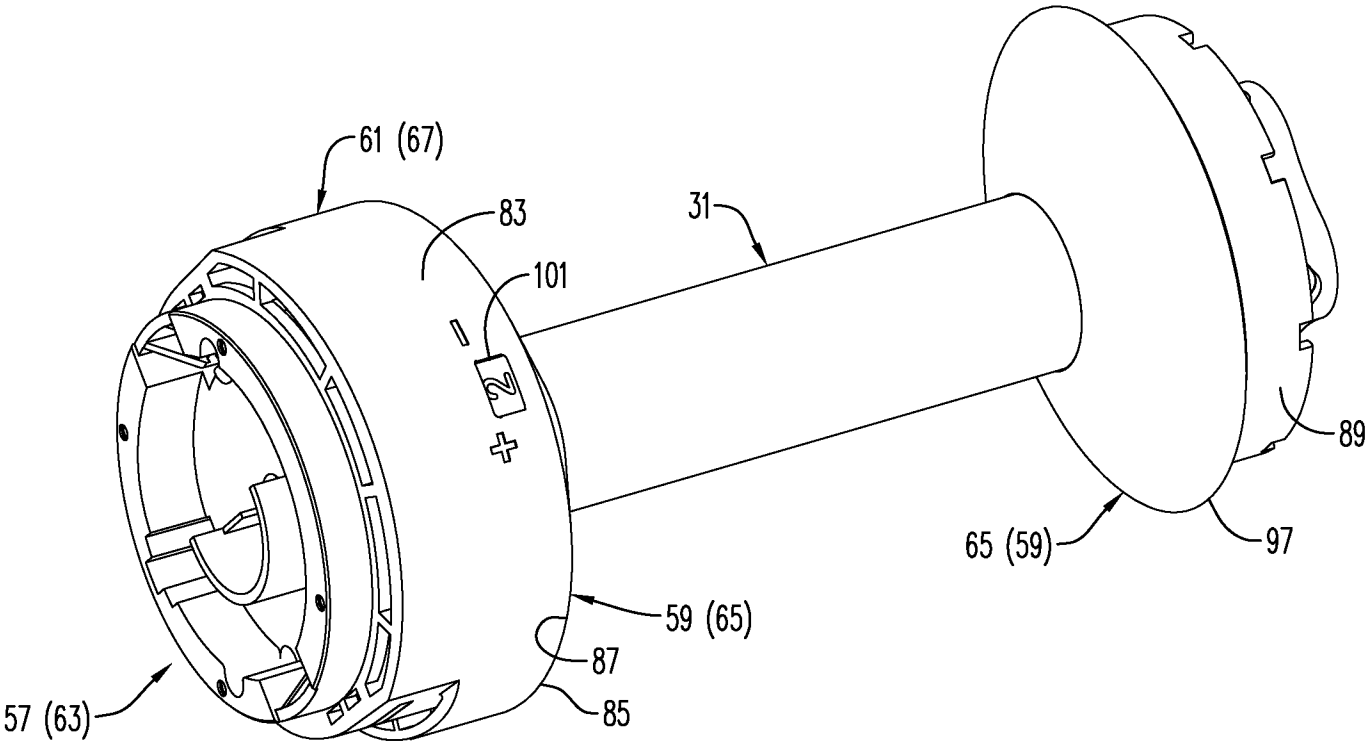
Figure 5H:
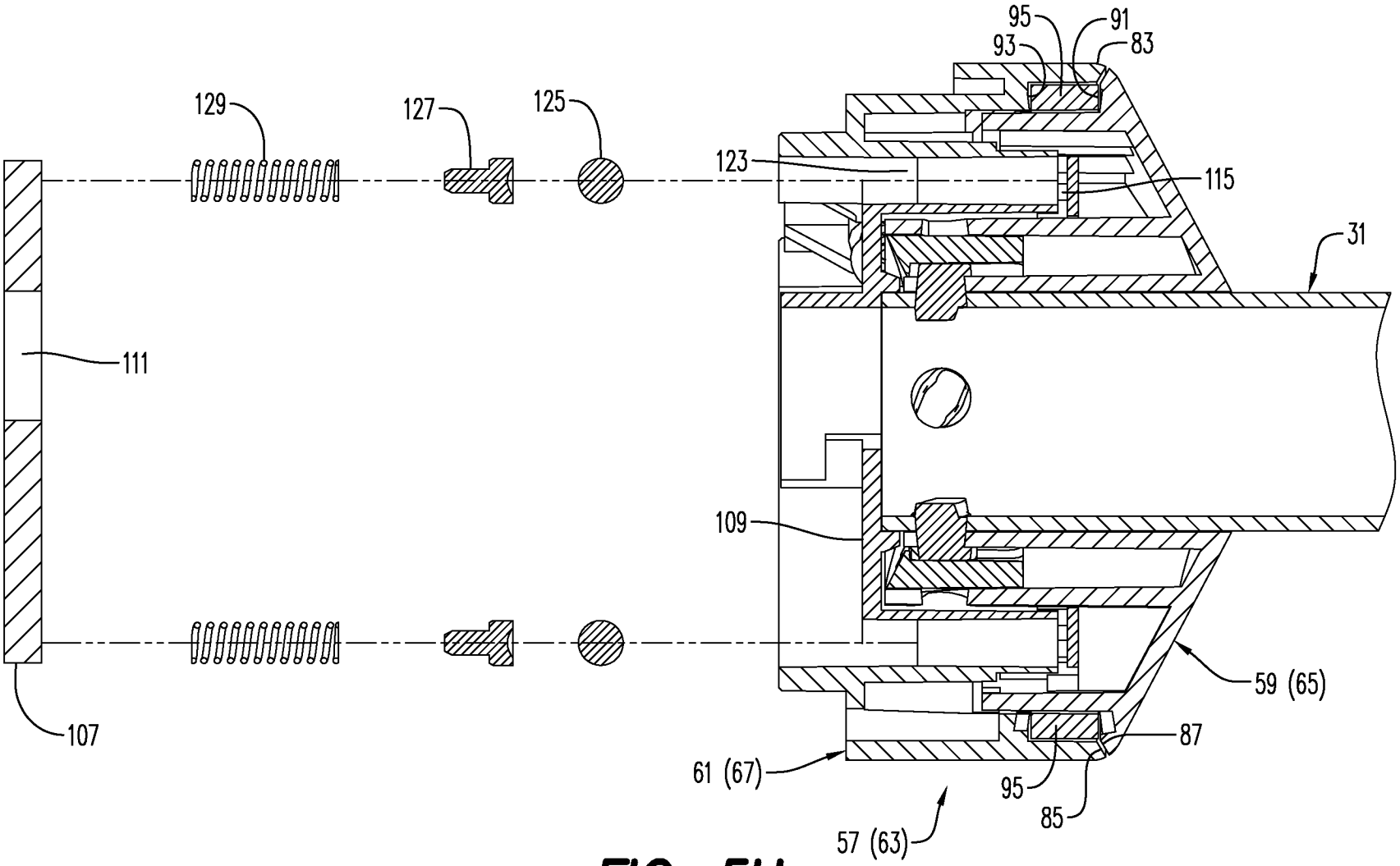
FIG. 5H is a partially exploded side cross-sectional view and FIG. 5I is an assembled cross-sectional view of a portion of a handle assembly including components of a click-plate assembly of an adjustable weight lifting device according to an aspect of the present invention.

As seen, for example, in FIGS. 5E and 5F, an index ring 95 comprising an exterior surface provided with indicia 97 and an inner surface 99 can be disposed around the circularly cylindrical portion 89 of the axially inner portions 59 and 65 and (as seen in FIG. 5H) inwardly of the circularly cylindrical tubular portion 83. The indicia 97 will ordinarily correspond to an amount of weight including the weight of the handle assembly 23 plus any weight disks 25 and/or butterfly weight disks attached to the handle. An opening 101 (e.g., FIGS. 5F and 5G) is provided in the circularly cylindrical tubular portion 83 of the axially outer portions 61 and 67 so that one of the indicia 97 corresponding to the amount of weight is visible through the opening.

As seen, for example, in FIGS. 5E and 5F, one or more gears or cogwheels 103 are mounted on the inner surface 99 of the index ring for rotation about one or more corresponding radially extending axes 105, each radially extending axis being perpendicular to a longitudinal axis of the index ring 95. The axes 105 may be in the form of a shaft as illustrated or, alternatively, the cogwheels may be free-floating. The circularly cylindrical tubular portion 83 of the axially outer portion 61 or 67 is fitted over the index ring 95 and the circularly cylindrical portion 89 of the axially inner portion 59 or 65, and each gear or cogwheel 103 meshes with the axially inner portion face gear 91 and the axially outer portion face gear 93. As a result of this gearing arrangement, rotation of the axially inner portions 59 and 65 relative to the axially outer portions 61 and 67 through a first angle results in rotation of the index ring 95 through a second angle that is smaller than the first angle. Consequently, the tube 31 can be rotated through more than 360 degrees before the index ring rotates through 360 degrees. This configuration facilitates indication of an amount of weight secured to the handle assembly 23 that results from turning of the tube 31 and the axially inner portions 59 and 61 relative to the first and second pins 33 and 37 so that the pins are extended from the tube that is caused by rotation of the tube and the axially inner portions through more than 360 degrees. It will be observed that the index ring 95 in the first housing 57 may have indicia 97 provided in an opposite direction than the index ring in the second housing 63 and, if provided, plus (+) and minus (−) indicia on the first housing will be reversed relative to such indicia on the second housing.

Figure 5I:
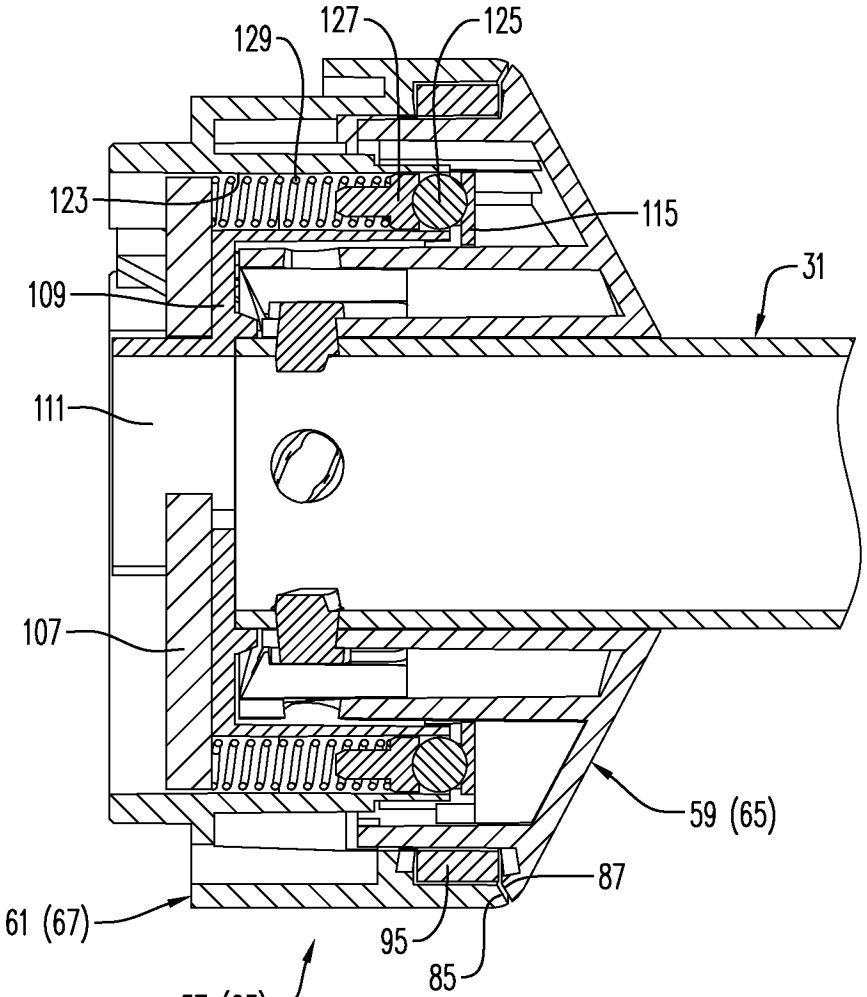

As seen, for example, in FIGS. 5H and 5I, a supporting plate 107 is fit inside each of the axially outer portions 61 and 67 and ordinarily abuts an axially outer surface 109 of a wall of the axially outer portions and an axially inner surface of the wall, in turn, ordinarily abuts the first and second ends 31' and 31" of the tube 31. The supporting plate 107 has a hole 111 provided therein for receiving one of the first and second pins 33 and 37. The hole 111 is ordinarily a half-circle as is the majority of the length of each of the first and the second pins 33 and 37.

As shown in FIGS. 4A-4B, to secure the axially outer portions 61 and 67 relative to the tube 31, the cylindrical member 45 is provided with notches 113, preferably on opposite sides of the cylindrical member. The cylindrical member 45 is extended through the tube 31 and positioned relative to the supporting plates 107 in each of the axially outer portions 61 and 67 so that the notches 113 receive an edge of the supporting plates and thereby prevent axial movement of the axially outer portions relative to the tube and the axially inner portions 59 and 65 that are secured to the tube.

As seen in FIG. 5D, a click plate 115 in the form of a disk with a plurality of holes 117 provided at equal angles around a radius of the disk and a central hole 119 in a shape corresponding to the exterior surface 71 of the cam knob 69 that permits the click plate to be securely fitted over the cam knob can be disposed against a surface 121 (FIG. 5A) of the axially inner portions 59 and 65. As seen in FIGS. 5H and SI, to provide a click plate assembly, the axially outer portions 61 and 67 can be provided with tubular portions 123 in which balls 125, pistons 127, and springs 129 can be placed and held in position by the supporting plates 107. The balls 125 are urged against the click plate 115 by the pistons 127 and springs 129 and are received in holes 117 of the click plate when the tube 31 and axially inner portions 59 and 65 have been turned relative to the axially outer portions 61 and 67, the cylindrical member 45 and the first and second pins 33 and 37 so that the first and second pins are in particular positions corresponding to indicia 97 on the index ring 95 (and corresponding to how many of the weight disks 25 and butterfly weight disks 27 are held on the handle assembly 23).

Figure 5J:
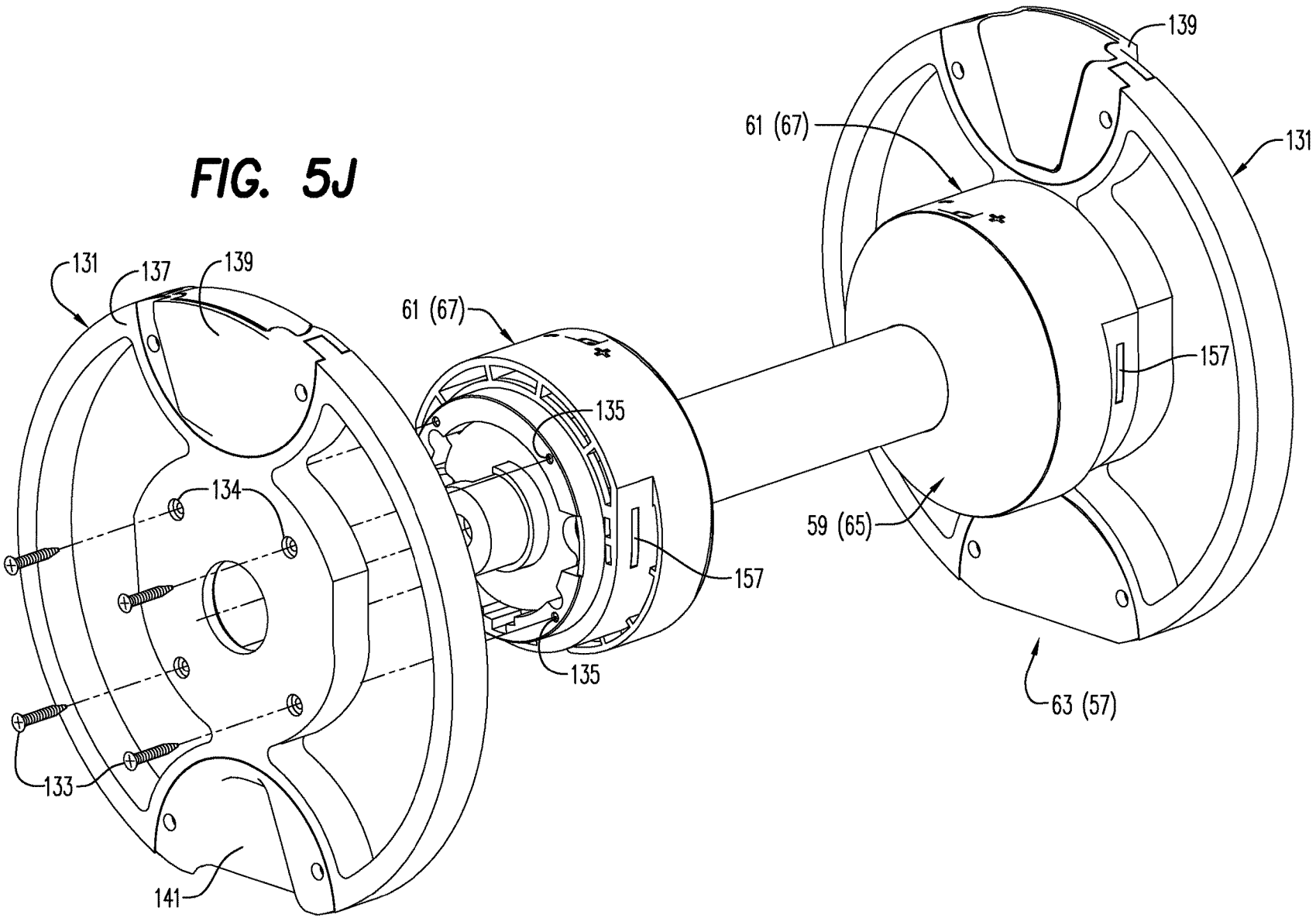
FIG. 5J is a partially exploded perspective view and FIG. 5K is an assembled view of a portion of a handle assembly including a handle weight of an adjustable weight lifting device according to an aspect of the present invention.
Figure 5K:
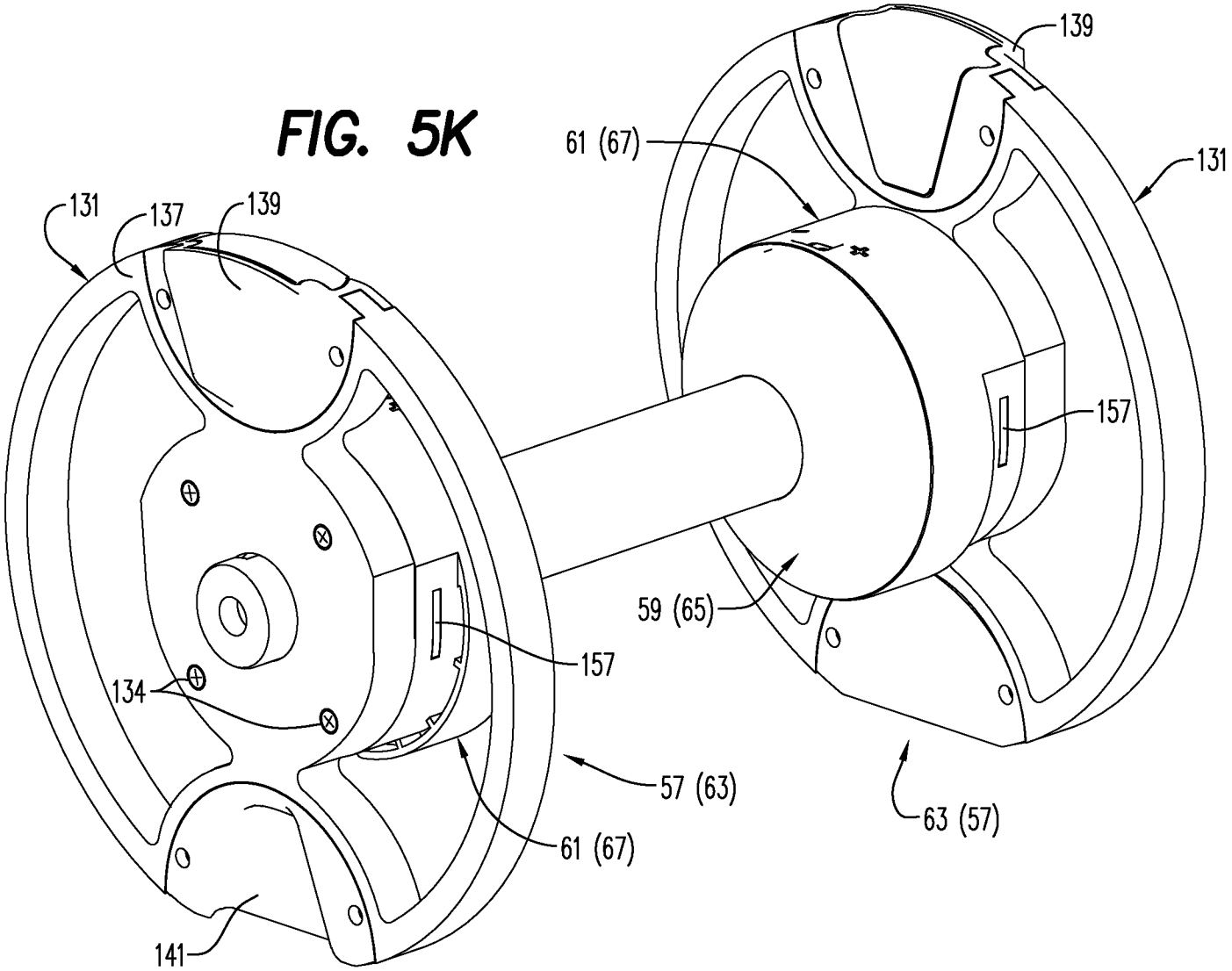

The handle assembly 23 further includes a handle weight 131 attached to each of the axially outer portions 61 and 67 as seen in FIGS. 5J and 5K. The handle weight 131 can be secured to the axially outer portions 61 and 67 by screws 133 that are received in holes 134 in the handle weight and holes 135 in the axially outer portions.

The handle weight 131 will ordinarily include, at least on an axially outward face 137, a top male dovetail joint member 139 at a top of the handle weight and a bottom female dovetail joint member 141 at a bottom of the handle weight. As seen in, e.g., FIG. 2*c*, each of the weight disks 25 may include a top female dovetail joint member 143 at a top of an axially inwardly facing side 145 of the weight disk 25 and a bottom female dovetail joint member 147 at a bottom of an axially outwardly facing side 149 of the weight disk, and a bottom male dovetail joint member 151 at a bottom of the axially inwardly facing side of the weight disk and a top male dovetail joint member 153 at a top of the axially outwardly facing side of the weight disk. Ordinarily, any bottom male dovetail joint member 151 is adapted to be received in any bottom female dovetail joint member 149, and any top male dovetail joint member 153 is adapted to be received in any top female dovetail joint member 143. Additionally, ordinarily, each bottom male dovetail member 151 of any weight disk is adapted to be received in a female bottom female dovetail joint member 141 of the handle weight 131, and each top male dovetail joint member 139 of the handle weight is adapted to be received in any top female dovetail joint member 143 of any weight disk 25. Connection of the dovetail joint members prevents axial movement of the weight disks 25 relative to each other, and axial movement of the weight disks relative to the handle weight 131. It will be appreciated that the references to male and female dovetail joint members can be reversed and that other joint structures than dovetail joints but that are similarly adapted to prevent axial movement of weight disks 25 relative to each other might be provided.

Figure 6A:
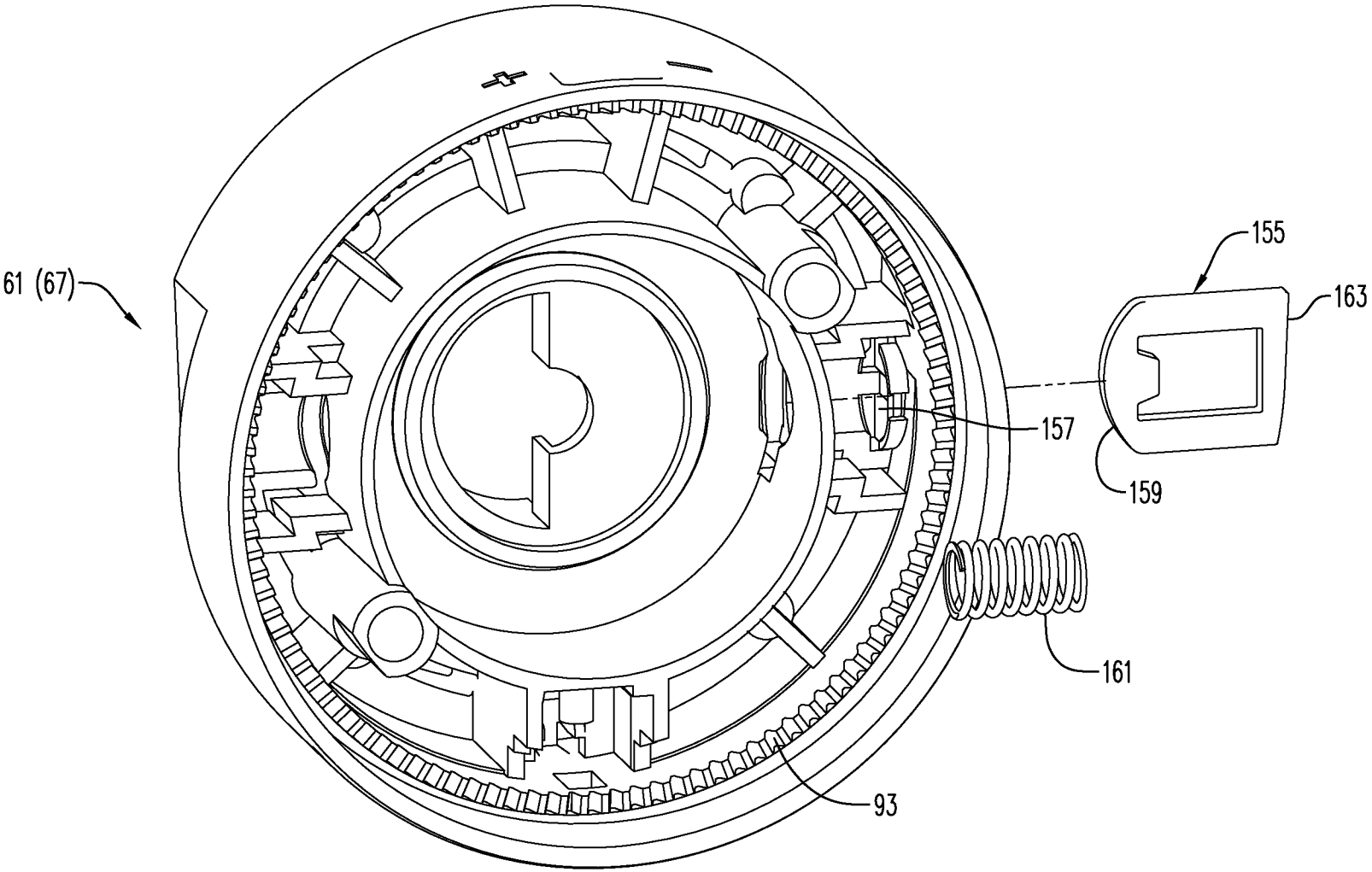
FIGS. 6A-6C are perspective end views of an axially outer portion of a housing of an adjustable weight lifting device including a lateral pin assembly according to an aspect of the present invention.
Figure 6B:
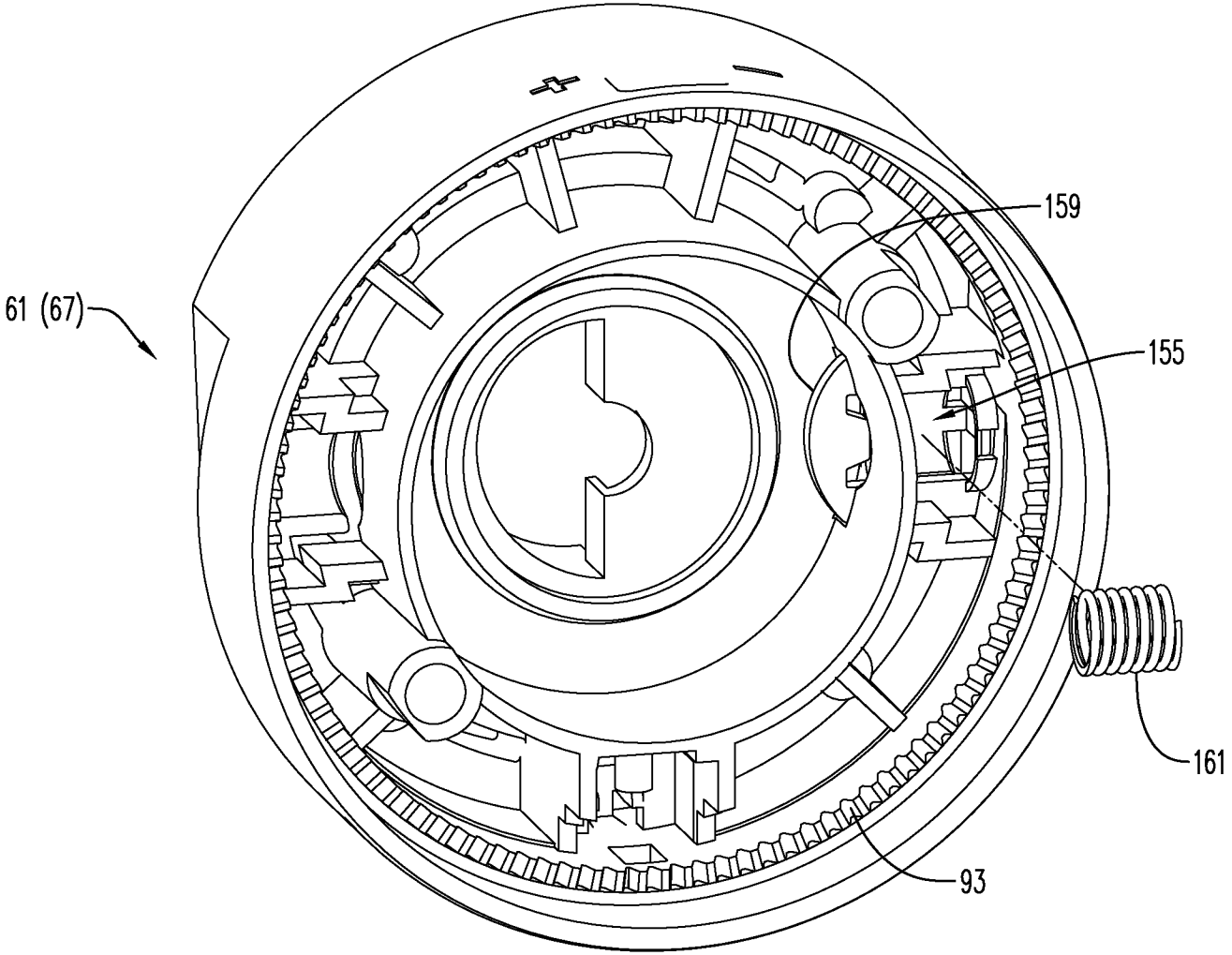
Figure 6C:
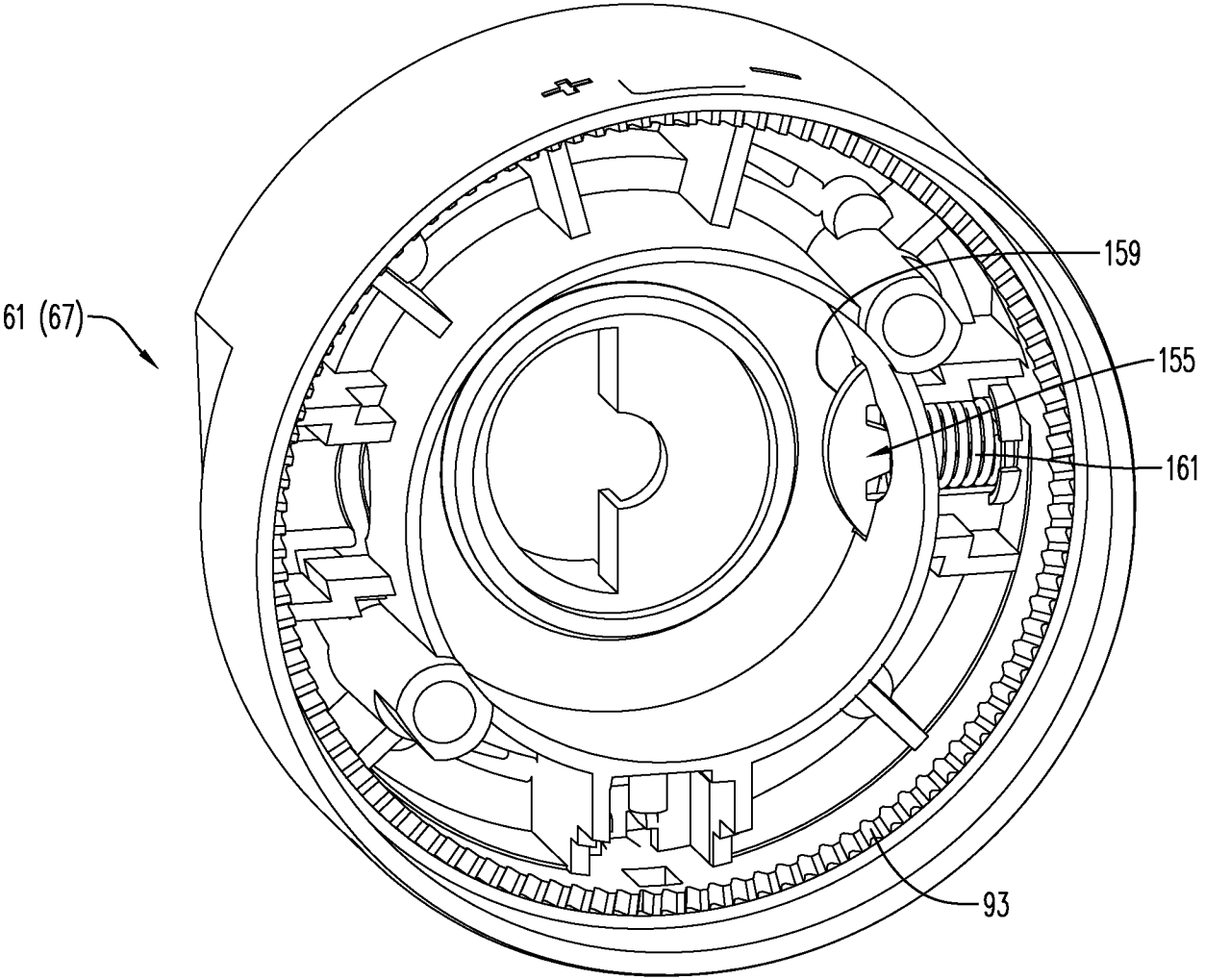

As seen in FIGS. 6A-6C, a lateral pin assembly can include one or more lateral pins 155 that can be spring mounted inside the axially outer portions 61 and 67 such that they are radially movable outwardly and inwardly relative to holes 157 (FIG. 6A) in the axially outer portions to connect and disconnect the butterfly weight disks to the handle assembly 23. Ordinarily, two lateral pins 155 are provided inside each axially outer portion 61 and 67 on opposite sides of each axially outer portion so that they are adapted to be moved outwardly and inwardly in opposite directions. A radially inner end 159 of each lateral pin 155 is urged against the exterior surface 71 of the cam knob 69 (e.g., FIGS. 5A-5C, not showing lateral pin 155) by a spring 161. When the cam knob 69 is turned so that the radially inner end 159 of a lateral pin 155 abuts a portion of the exterior surface 71 of the cam knob at the greater distance D2 (FIG. 5A) from the axial center of the tube 31, then the lateral pin is moved radially outward against a spring force out of a corresponding hole 157 in the axially outer portion 61 or 67 so that a radially outer end 163 of the lateral pin extends past an exterior surface of the axially outer portion 61 or 67 and is at a maximum radial distance from an axial center of the tube. When the radially inner 159 of a lateral pin 155 abuts a portion of the exterior surface of the cam knob that is at the first distance D1 (FIG. 5A) from the axial center of the tube 31, then the radially outer end 163 of the lateral pin is retracted radially inward of the exterior surface of the axially outer portion 61 or 67 under the force of the spring 161.

Figure 2A:
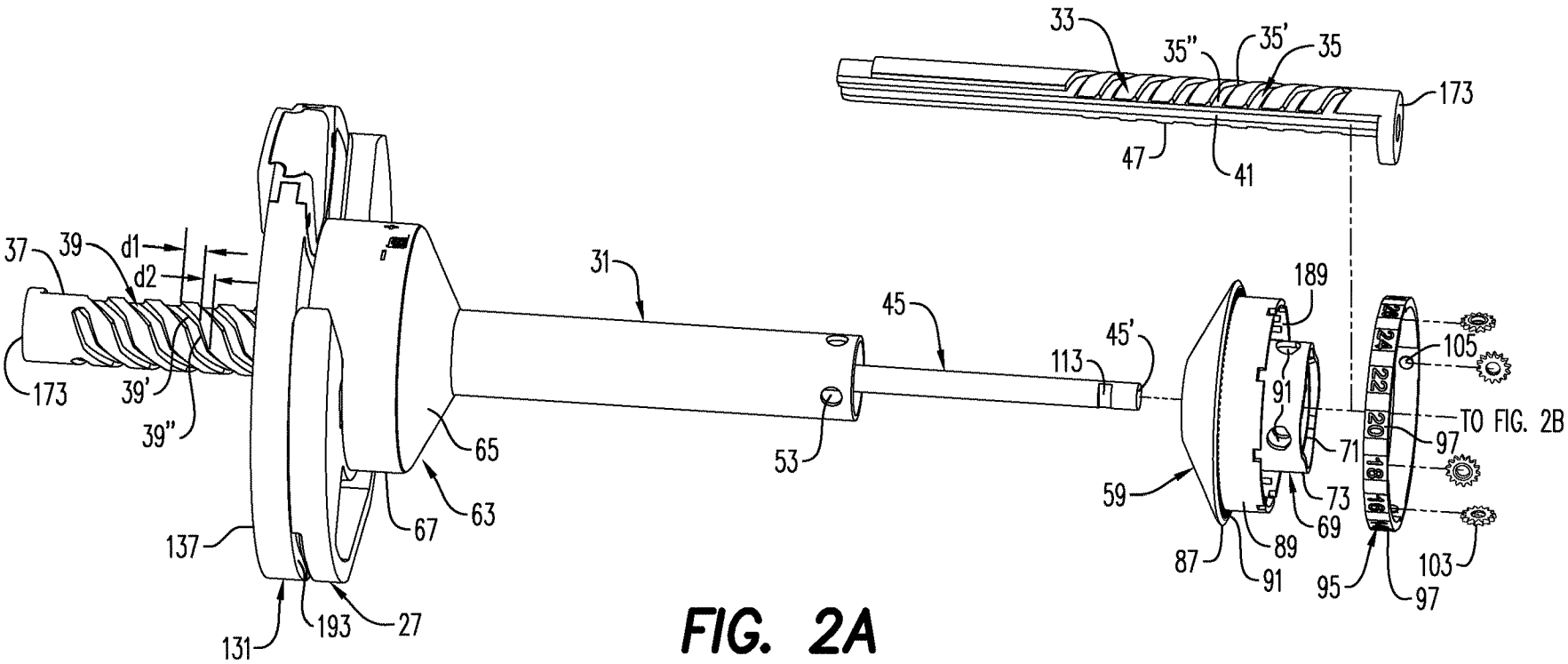
FIGS. 2*a-d* are an exploded perspective view of an adjustable weight lifting device according to an aspect of the present invention.
Figure 2B:
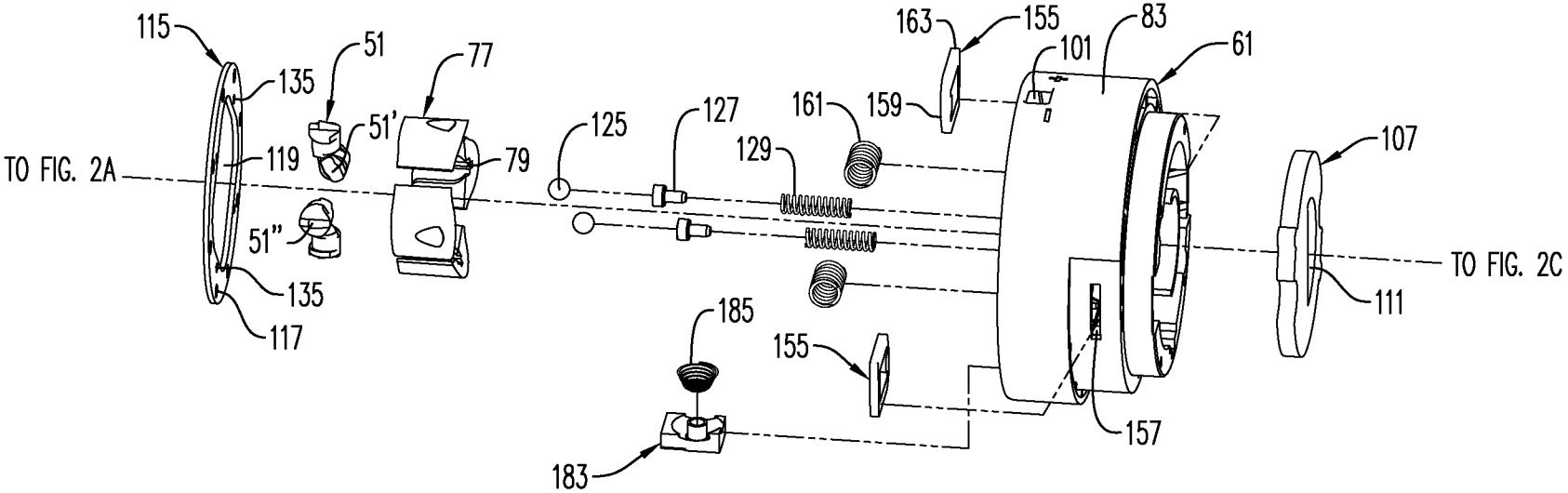
Figure 2C:
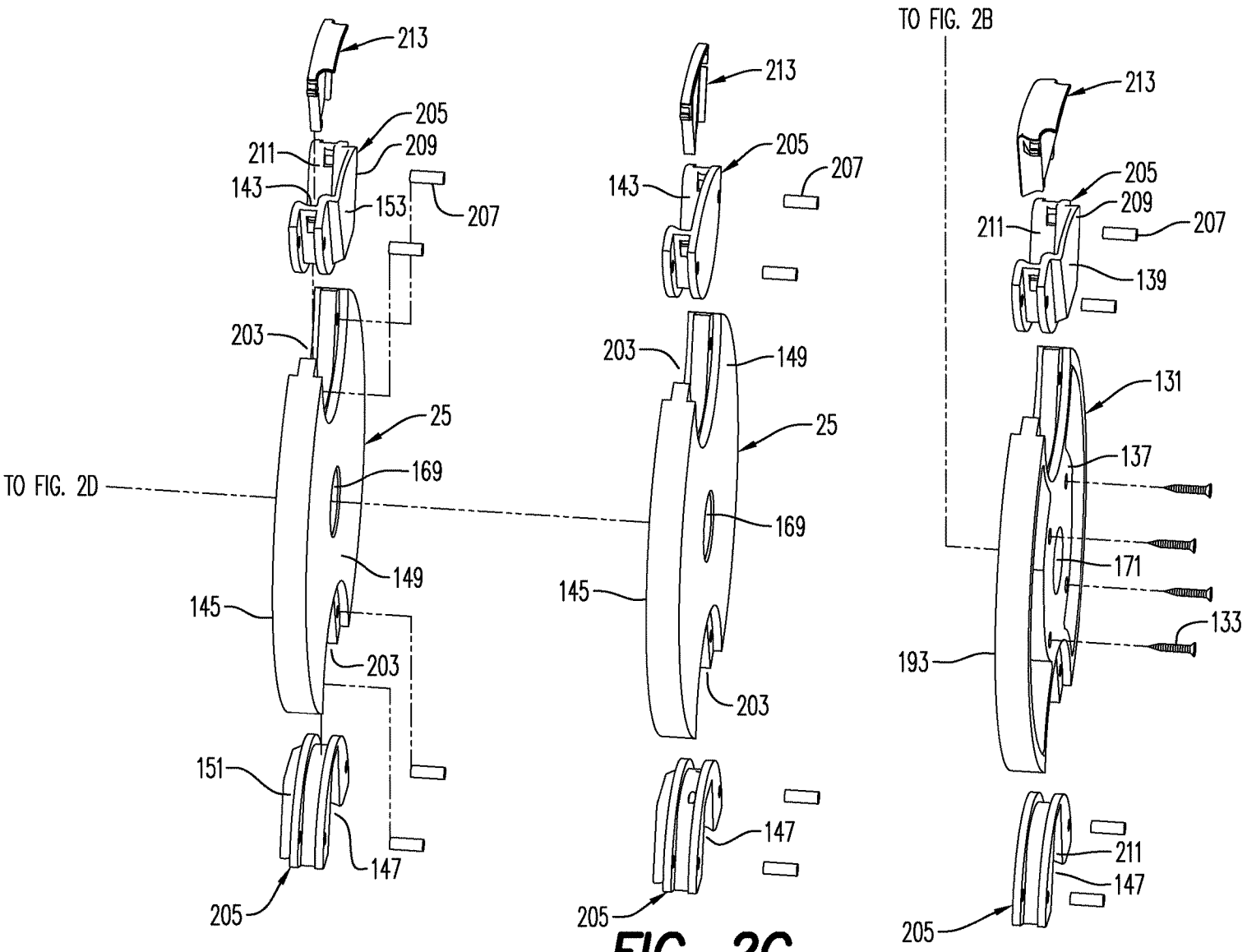
Figure 2D:
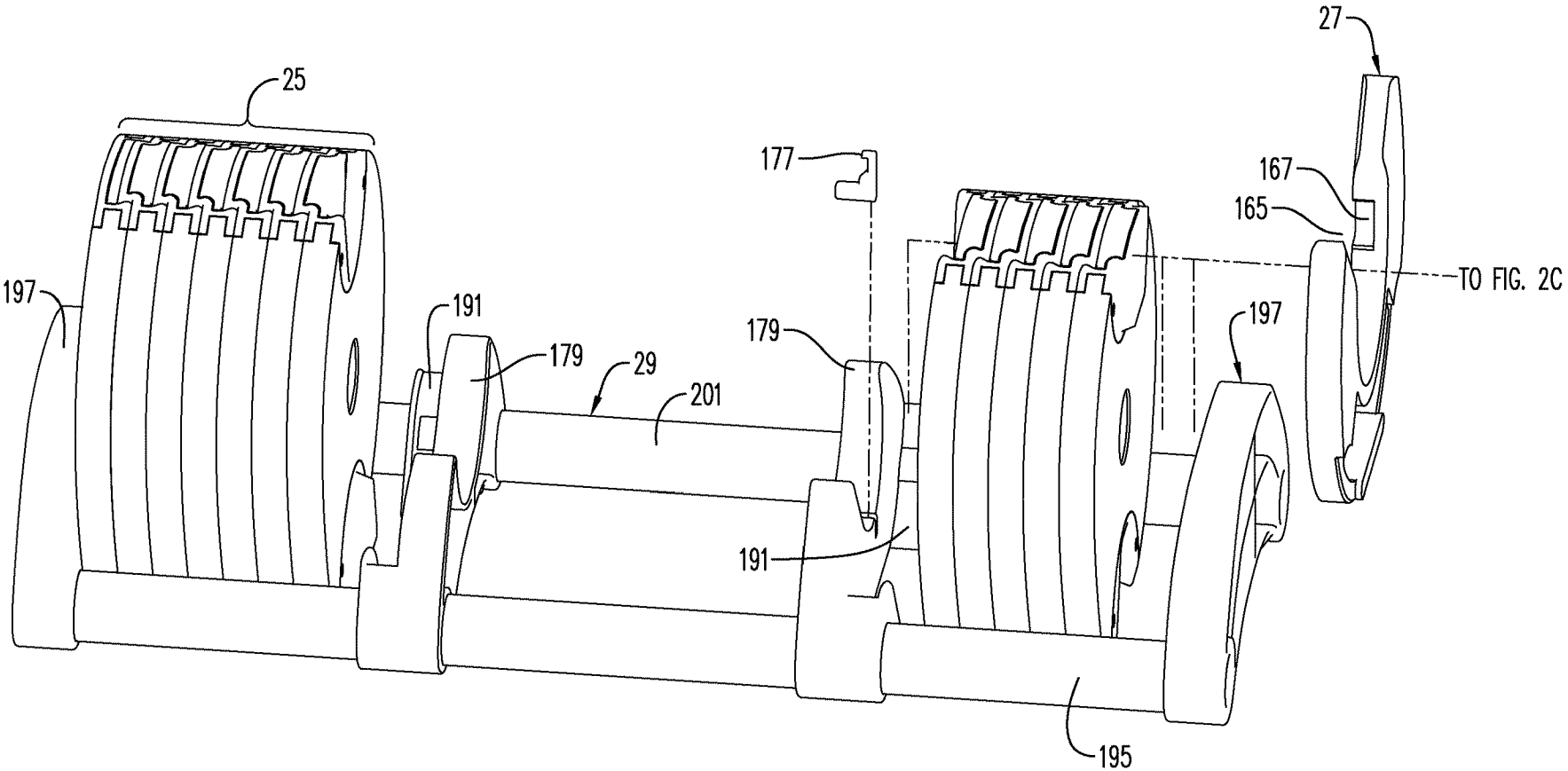

As seen in, e.g., FIG. 2*d*, each butterfly weight disk 27 has a recess 165 extending radially inward from a periphery of the butterfly weight disk in which an axially outer portion 61 or 67 of the first or second housing 57 or 63 is adapted to be received (as seen, for example, in FIG. 1). The butterfly weight disks 27 are radially movable relative to the axially outer portions 61 or 67 when the lateral pins 155 are retracted radially inward of the axially outer portion, i.e. the handle assembly 23 can be lifted away from the butterfly weight disks out of the recesses 165 in the butterfly weight disks. Each butterfly weight disk 27 comprises radially extending openings 167 corresponding in number to the lateral pins 155 on each housing 57 and 63. The radially extending openings 167 are arranged to receive a corresponding one of the lateral pins 155 when the lateral pins are moved radially out of the holes 157 so that radial and axial movement of the butterfly weight disk 27 relative to the axially outer portions 61 and 67 is prevented.

After the first and second pins 33 and 37 are rotated relative to the tube 31 so that the one or more driving knobs 51 have moved along the portions 35' and 39' of the external threads 35 and 39 having the first (larger) helix angle and are disposed at a point where the external thread transitions to the second (smaller) helix angle, the cam knob 69 is rotated to a position such that the one or more lateral pins 155 are retracted radially inward of the axially outer portion, i.e. the lateral pins are urged inwardly by the springs 161 against a smallest diameter D1 portion of the exterior surface 73 of the cam knob.

After the first and second pins 33 and 37 are rotated relative to the tube 31 so that the one or more driving knobs 51 have moved along the portions 35" and 39" of the external threads 35 and 39 having the second (smaller) helix angle and are disposed at a point where the external thread transitions to the first (larger) helix angle, the one or more lateral pins 155 are moved radially out of the one or more corresponding holes 157 against the force of the spring 161, i.e. the lateral pins are urged outwardly by the largest diameter D2 portion of the exterior surface of the cam knob 69.

Weight disks 25 are attached to the handle assembly 23 by providing a first or innermost one of the weight disks 25 disposed adjacent each handle weight 131 so that dovetail joint members in the first weight disk and the handle weight mate and prevent axial movement of the first weight disk relative to the hand weight. As seen, for example, in FIG. 2*c*, each weight disk 25 has a hole 169 extending axially therethrough and that is intended to be axially aligned with a hole 171 in the handle weight 131 and with a center axis of the tube 31 when the weight disk is disposed relative to the handle weight with dovetail joints mating as described. When disposed in an axially innermost position, axially outer ends 173 of the first and second pins 33 and 37 extend past the axially outer ends 175 (FIG. 3) of the axially outer portions 61 and 67 by an axial distance d1 (FIG. 2*a*) that is less than a thickness of the handle weight 131, and are ordinarily disposed axially inward of the exterior surface 137 of the handle weight by a distance d2, the handle weight ordinarily being of the same axial thickness as the other weight disks 25.

The distance d1 is ordinarily equal to an axial length of a large helix angle portion 35' or 39' of the thread 35 or 39. The distance d2 is ordinarily equal to an axial length of a smaller helix angle portion 35" or 39" of the thread 35 or 39. It is presently preferred that d1 is greater than one half of the thickness of the handle weight 131 or the weight disks 25. The sum of the distances d1 and d2 will ordinarily equal the thickness of the handle weight 131 or the weight disks 25. When the axially outer ends 173 of the first and second pins 33 and 37 are at their axially innermost positions, the lateral pins 155 are retracted inside the axially outer portions 61 and 67 and no weight disks 25 or butterfly weight disks 27 are attached to the handle assembly 23.

Upon rotation of the axially outer portions 61 and 67 including the first and second pins 33 and 37 relative to axially inner portions 59 and 65 and the tube 31 so that the one or more driving knobs 51 have moved (e.g., axially inwardly relative to axial outer ends 173 of the pins so that the pins are caused to extend further axially outwardly from the tube) along the portions 35" and 39" of the external threads 35 and 39 having the second (smaller) helix angle and are disposed at a point where the external thread transitions to the first (larger) helix angle, the lateral pins 155 are moved radially out of the corresponding holes 157 against the force of the spring 161, i.e. the lateral pins are urged outwardly by the largest diameter D2 portion of the exterior surface of the cam knob 69 and the lateral pins are received in the radially extending openings 167 in the butterfly weight disks 27 so that the butterfly weight disks are prevented from moving axially and radially relative to the handle assembly 23. In this position, the axially outer ends 173 of the first and second pins 33 and 37 have moved from their axially innermost positions a distance d2 (FIG. 2*a*) through the hole 171 and are ordinarily flush with the axially outer face 137 of the handle weight 131. It will be appreciated that references to rotation of the axially outer portions 61 and 67 including the first and second pins 33 and 37 relative to axially inner portions 59 and 65 and the tube 31 simply means that there is relative movement between the axially outer portions and the axially inner portions. Ordinarily, when the handle assembly 23 is seated in the rack 29, a user rotates the axially inner portions 59 and 65 and tube 31 relative to the axially outer portions 61 and 67, the weight disks 25, the butterfly weight disks 27, and the rack 29.

Upon continuing to rotate the axially outer portions 61 and 67 including the first and second pins 33 and 37 relative to axially inner portions 59 and 65 and the tube 31, the pins are received in the holes 169 in the first weight disks 25 adjacent the handle weights 131 and the axially outer ends 173 of the pins extend into the holes by the distance d1 as the result of the driving knobs 51 having moved along the portions 35' and 39" of the external threads 35 and 39 having the largest helix angles. When the pins 33 and 37 are received in the holes 169 in the first weight disks, radial movement of the first weight disks relative to the housings 57 and 63 is prevented. Because the first weight disks 25 are prevented from axial movement by the mating dovetail joints on the first weight disks and the handle weights 131, the first weight disks are thus secured to the handle assembly 23. In this position, the lateral pins 155 are retracted radially inward relative to the axially outer portions 61 and 67 and the butterfly weights 27 are released from the handle assembly 23. By causing the axially outer ends 173 of the pins 33 and 37 to extend into the holes 169 in the first weight disk 25 by a larger distance d1, the pins 33 and 37 can better prevent radial movement of the first weight disk relative to the handle assembly 23 than if the external thread has a constant helix angle and the distance d1 and d2 are equal so that the distance d1 is one half the thickness of the weight disk instead of greater than one half the thickness of the weight disk.

Upon continuing to rotate the axially outer portions 61 and 67 including the first and second pins 33 and 37 relative to axially inner portions 59 and 65 and the tube 31 so that the one or more driving knobs 51 have moved along further portions 35" and 39" of the external threads 35 and 39 having the second (smaller) helix angle and are disposed at a point where the external thread transitions to the first (larger) helix angle, the lateral pins 155 are moved radially out of the corresponding holes 157 against the force of the spring 161, i.e. the lateral pins are urged outwardly by the largest diameter D2 portion of the exterior surface of the cam knob 69 and the lateral pins are received in the radially extending openings 167 in the butterfly weight disks 27 so that, once again, the butterfly weight disks are prevented from moving axially and radially relative to the handle assembly 23. At the same time, the first weight disk 25 is also prevented from moving axially and radially relative to the handle assembly.

Upon continuing to rotate the axially outer portions 61 and 67 including the first and second pins 33 and 37 relative to axially inner portions 59 and 65 and the tube 31, the pins are received in the holes 169 in next innermost weight disks 25 adjacent to and axially outward of the first weight disks and the axially outer ends 173 of the pins extend into the holes of the next innermost weight disk by the distance d1 as the result of the driving knobs 51 having moved along the further portions 35' and 39" of the external threads 35 and 39 having the largest helix angles. When the pins 33 and 37 are received in the holes 169 in the next innermost weight disks 25, radial movement of the next innermost weight disks relative to the housings 57 and 63 is prevented. Because the next innermost weight disks 25 are prevented from axial movement by the mating dovetail joints on the next innermost weight disks and the first weight disks, the next innermost weight disks are secured to the handle assembly 23. In this position, the lateral pins 155 are again retracted radially inward relative to the axially outer portions 61 and 67 and the butterfly weights 27 are released from the handle assembly 23.

By continuing to rotate the axially outer portions 61 and 67 including the first and second pins 33 and 37 relative to axially inner portions 59 and 65 and the tube 31 so that the axially outer ends 173 of the pins extend further and further axially outward, further weight disks 25 can be attached to the handle assembly 23 in the manner described. Additionally, the butterfly weight disks 27 can alternately be attached to and released from the handle assembly 23 in the manner described. Ordinarily, the butterfly weight disks 27 will have a weight that is one half of the weight of the weight disks so that, by rotating the axially outer portions 61 and 67 including the first and second pins 33 and 37 relative to axially inner portions 59 and 65 and the tube 31, incremental addition of weight can be made in an amount equal to the weight of the butterfly weight disks.

By providing the external threads 35 and 39 on the first and second pins 33 and 37 each with at least one portion 35' and 39', respectively, having the first helix angle and at least one portion 35" and 39", respectively, having the second helix angle that is smaller than the first helix angle, it is possible to advance the pins in a desirable manner. Particularly, when a user turns the tube 31 and axially inner portions 59 and 65 of the first and second housings 57 and 63 through an angle relative to the axially outer portions 61 and 67, the first and second pins 33 and 37 will be extended or retracted relative to the tube 31 the lesser amount d2 when the driving knobs 51 engage with the portions 35" and 39" of the threads 35 and 39 having the smaller second helix angle than the distance d1 when the driving knobs engage with the portions 35' and 39' of the threads having the larger first helix angle. In a presently preferred embodiment, d1 is about 70% of a thickness of the weight disks 25 and d2 is about 30% of the thickness of the weight disks.

Figure 7A:
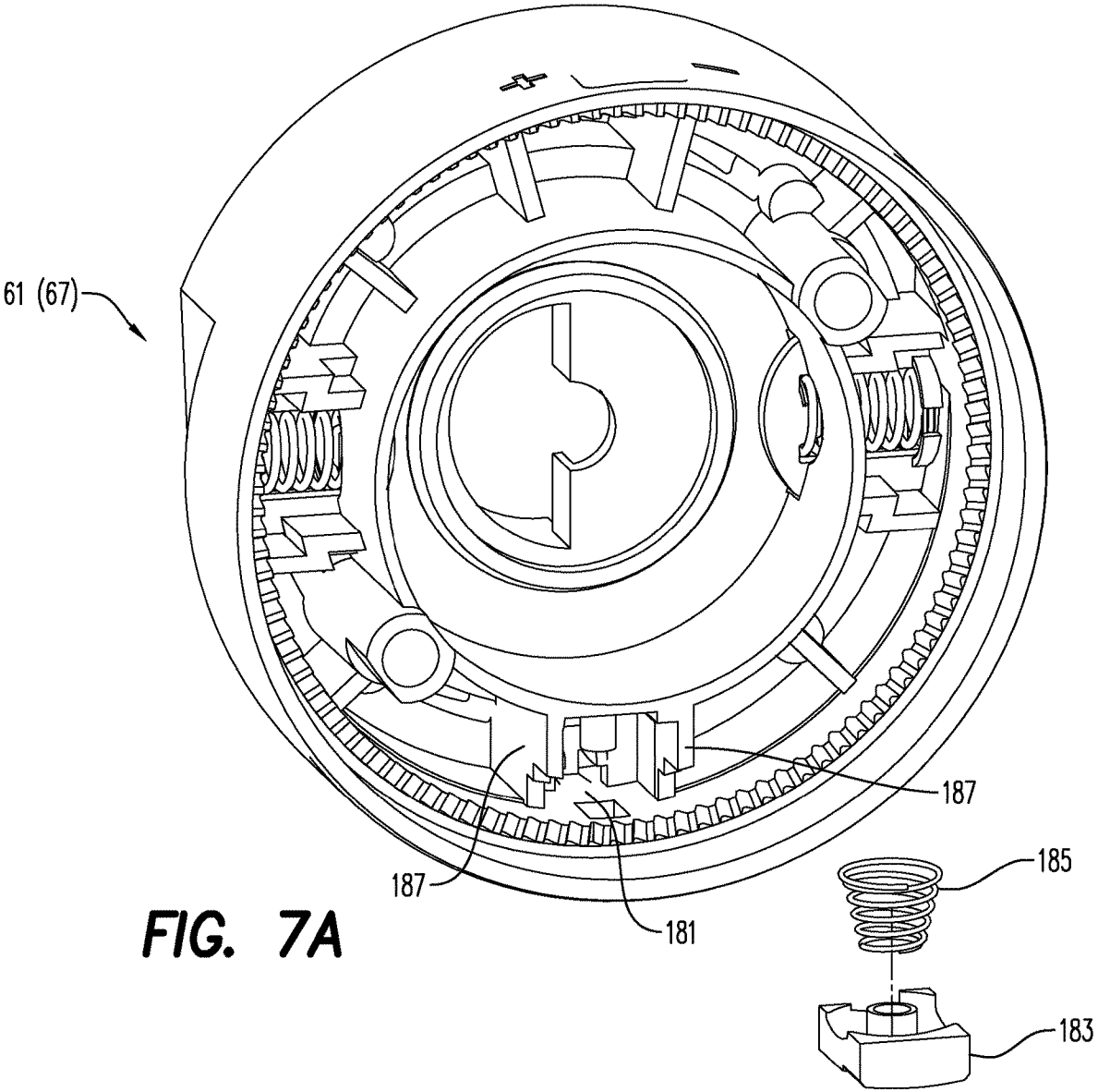
FIGS. 7A-7B are perspective end views of an axially outer portion of a housing of an adjustable weight lifting device including a stop assembly according to an aspect of the present invention.
Figure 7B:
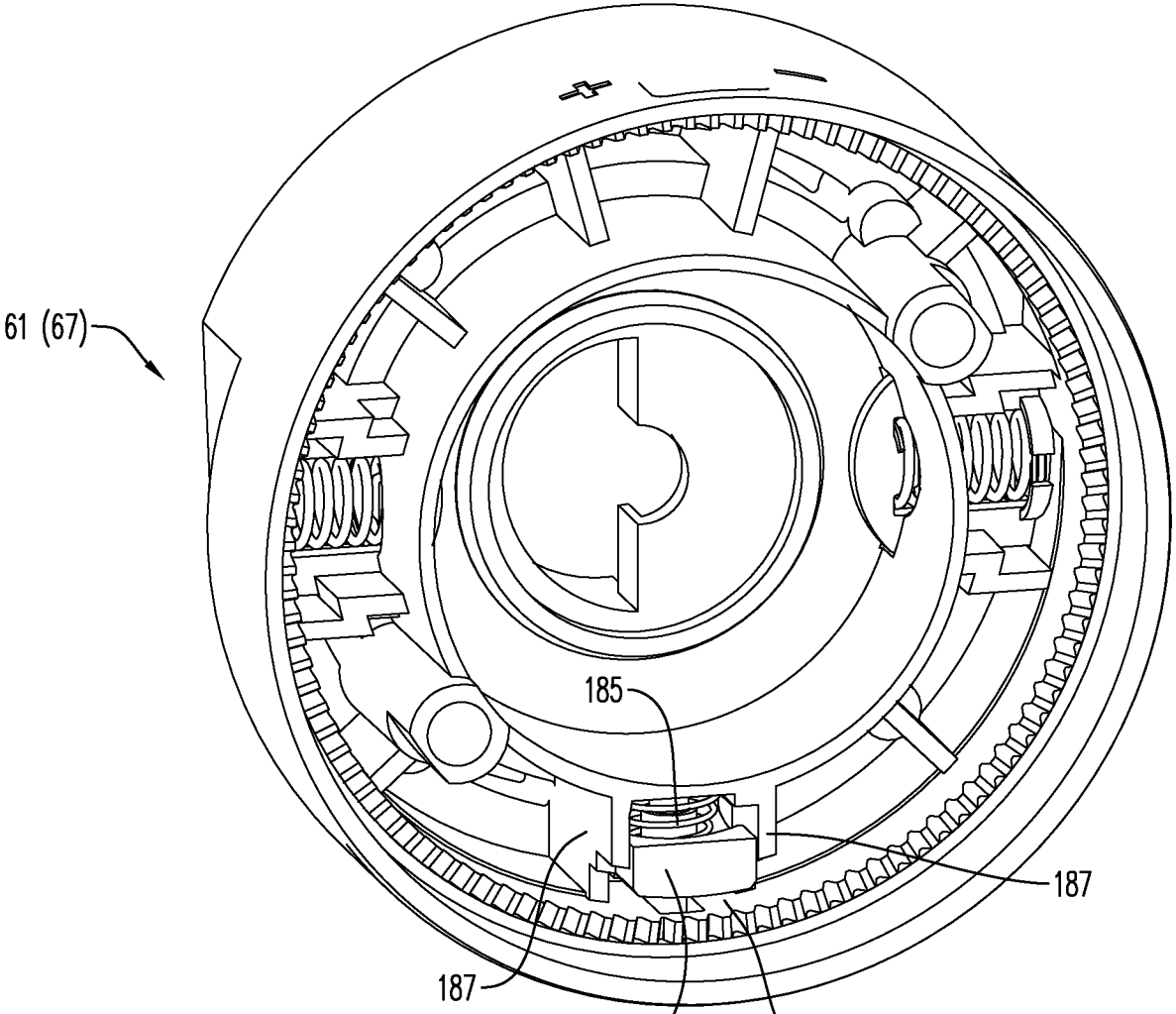

The axially inner portions 59 and 65 of the first and second housings 57 and 63 are ordinarily only rotatable relative to the axially outer portions 61 and 67 when the handle assembly 23 is seated in the rack 29 so that protrusions 177 (FIG. 2*d*) on housing supporting portions 179 (FIG. 2*d*) of the rack are received in openings 181 (FIG. 7A) in the axially outer portions. A stop assembly can include a stop member 183 and a spring 185 that are mounted in the axially outer portions 61 and 67 as shown in FIGS. 7A and 7B. The spring 185 urges the stop member 183 radially outwardly. The stop member 183 is only radially movable between walls 187 in the axially outer portions 61 and 67. When the handle assembly 23 is not seated in the rack so that the protrusions 177 are received in the openings 181, the spring 185 urges the stop member 183 radially outwardly so that part of the stop member (not shown) is received in recessed areas 189 (e.g., FIG. 5A-5B) in the axially inner portions 59 and 65 and thereby locks the axially inner portions relative to the axially outer portions 61 and 67. When the handle assembly 23 is seated in the rack so that the protrusions 177 are received in the openings 181, the protrusions urge the stop members 183 radially outwardly against the force of the springs 185 so that the part of the stop member is removed from recessed areas 189 in the axially inner portions 59 and 65 so that rotation of the axially inner portions relative to the axially outer portions 61 and 67 is permitted.

As seen, for example, in FIGS. 1 and 2*d*, the rack 29 also includes butterfly weight disk supporting portions 191 that are arranged to support the butterfly weight disks 27 so that they will be adjacent axially inner faces 193 (FIG. 2*c*) of the handle weights 131 and are properly positioned to receive the lateral pins 155 in the radially extending openings 167 in the butterfly weight disk when the handle assembly 23 is seated in the rack.

The rack 29 also includes weight disk supporting portions 195 that are arranged to support the weight disks 25 so that the axially innermost one of the weight disks is adjacent the axially outer face 137 of the handle weight and so that axially outermost ones of the weight disks are adjacent axially outer frame portions 197 of the rack. The axially outer frame portions 197 can include a male or female dovetail or other suitable joint member 199 for mating with a corresponding female or male joint member on an axially outer bottom of the axially outermost one of the weight disks 25. The axially outer frame portions 197 can be connected via longitudinal frame portions 201 on which the weight disks 25 can rest.

The joint members 139, 141, 143, 147, 161, 163, 199 can be formed integrally with the weight disks 25, handle weight 131, and axially outer frame portions 195, however, as seen in, for example, FIGS. 2*a*-*d*, at least with regard to the weight disks and the handle weight, it has been found to be convenient to provide recesses 203 in peripheral surfaces of the weight disks and the handle weight and attach joint components 205 in the recesses with suitable fasteners such as pins, bolts, screws, or the like 207.

The joint components 205 can be provided with a male joint component 209 on one side and a female joint component 211 on an opposite side and can be used either on the top or the bottom of the weight disks 25 and the handle weight 131. The male and female joint components 209 and 211 may be provided with a wedge shape to facilitate introduction of male joint components on one weight disk 25 or handle weight 131 into female joint components on other weight disks or handle weights. It will be observed that certain joint components 205 may be differentiated from other joint components by the introduction of a particular form of cover 213 in the female joint component. Additionally, a male joint member may be omitted on the axially outer surface of the outermost weight disks 25 and on the axially inner surface of the handle weight 131, such as by providing covers 213 and/or joint components 205 with different shapes. The joint member 199 on the axially outer frame portion 195 is illustrated as having been integrally formed with the axially outer frame portion, however, it, also, may be provided by installing a joint component 205 in a recess in the axially outer frame portion.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. An adjustable weight lifting device, comprising:

a tube;

wherein the adjustable weight lifting device includes:

a cylindrical member disposed in the tube, the tube and the cylindrical member being rotatable relative to each other and axially fixed relative to each other;

a first housing having an axially inner portion nonrotatably attached to the tube at a first end of the tube and an axially outer portion nonrotatably attached to the cylindrical member at a first end of the cylindrical member, and a second housing having an axially inner portion nonrotatably attached to the tube at a second end of the tube and an axially outer portion nonrotatably attached to the cylindrical member at a second end of the cylindrical member.

2. The adjustable weight lifting device as set forth in claim 1, further comprising a first pin and a second pin, the first pin and the second pin being axially and rotatably movable relative to the tube, the cylindrical member being disposed in axially extending recesses in both the first pin and the second pin.

3. The adjustable weight lifting device as set forth in claim 2, wherein the first pin comprises an external thread and the second pin comprises an external thread;

the adjustable weight lifting device further comprising one or more driving knobs extending radially inward relative to an inner wall of the tube and engaging with the external threads of the first pin and the second pin, wherein the external threads each comprises at least one portion having a first helix angle and at least one portion having a second helix angle, the second helix angle being smaller than the first helix angle.

4. The adjustable weight lifting device as set forth in claim 3, wherein the external thread of the first pin has a first hand and the external thread of the second pin has a second hand opposite the first hand.

5. The adjustable weight lifting device as set forth in claim 4, wherein the first pin and the second pin each has a recess along at least a majority of a length of each of the first pin and the second pin, the cylindrical member being disposed in the recess of both the first pin and the second pin.

6. The adjustable weight lifting device as set forth in claim 5, wherein the axially inner portions of the first and second housings are rotatable relative to the axially outer portions of the first and second housings.

7. The adjustable weight lifting device as set forth in claim 3, wherein the one or more driving knobs are pivotably attached to the tube and comprise radially inward ends having elongated shapes for being received in the external threads of the first pin and the second pin, the one or more driving knobs being adapted to pivot relative to the tube to align the elongated shapes with the at least one portion of the first pin and the second pin having the first helix angle and to pivot relative to the tube to align the elongated shapes with the at least one portion of the first pin and the second pin having the second helix angle.

8. The adjustable weight lifting device as set forth in claim 1, further comprising a cam knob having an exterior surface that varies between a first distance from an axial center of the tube and a second distance from the axial center of the tube, the second distance being greater than the first distance, the cam knob being attached to and rotatable with the axially inner portion of the first housing and at least partially disposed inside the axially outer portion of the first housing, one or more lateral pins spring mounted inside the axially outer portion of the first housing and urged against the cam knob and adapted to be moved radially against a spring force out of one or more corresponding holes in the axially outer portion of the first housing when in contact with a portion of the exterior surface of the cam knob that is at the second distance and to be retracted radially inward of the axially outer portion of the first housing under the spring force when in contact with a portion of the exterior surface of the cam knob that is at the first distance, and a butterfly weight disk having a recess extending radially inward from a periphery of the butterfly weight disk in which the axially outer portion of the first housing is adapted to be received and to be radially movable relative to the first housing when the one or more lateral pins are retracted radially inward of the axially outer portion of the first housing, the butterfly weight disk comprising one or more radially extending openings arranged to receive the one or more lateral pins when the one or more lateral pins are moved radially out of the one or more corresponding holes so that radial and axial movement of the butterfly weight disk relative to the axially outer portion of the first housing is prevented.

9. The adjustable weight lifting device as set forth in claim 8, wherein, when the first pin is rotated relative to the tube so that the one or more driving knobs have been moved axially inwardly relative to an axially outer end of the first pin along a portion of the external thread of the first pin having the first helix angle and are disposed at a point where the external thread of the first pin transitions to the second helix angle, the one or more lateral pins are retracted radially inward of the axially outer portion of the first housing and away from the one or more radially extending openings in the butterfly weight disk.

10. The adjustable weight lifting device as set forth in claim 9, wherein, when the first pin is rotated relative to the tube so that the one or more driving knobs have been moved axially inwardly relative to an axially outer end of the first pin along a portion of the external thread of the first pin having the second helix angle and are disposed at a point where the external thread of the first pin transitions to the first helix angle, the one or more lateral pins are moved radially out of the one or more corresponding holes and into the one or more radially extending openings in the butterfly weight disk.

11. The adjustable weight lifting device as set forth in claim 10, further comprising a first weight disk having a hole extending axially therethrough and attachable to an axially outer end of the axially outer portion of the first housing, the first pin being axially movable relative to the tube and the first housing upon rotation of the tube relative to the axially outer portion of the first housing so that the first pin is received in the hole in the first weight disk and prevents radial movement of the first weight disk relative to the first housing.

12. The adjustable weight lifting device as set forth in claim 11, wherein an axially outer end of the first pin enters the hole in the first weight disk only after the first pin is rotated relative to the tube so that the one or more driving knobs begin to move axially inwardly relative to an axially outer end of the first pin along the at least one portion of the external thread of the first pin having the first helix angle.

13. The adjustable weight lifting device as set forth in claim 11, wherein an axially outer end of the first pin is flush with an axially outer end of the hole in the first weight disk after the first pin is rotated relative to the tube so that the one or more driving knobs have been moved axially inwardly relative to an axially outer end of the first pin along the at least one portion of the external thread of the first pin having the first helix angle and along the at least one portion of the external thread of the first pin having the second helix angle.

14. The adjustable weight lifting device as set forth in claim 13, wherein the first weight disk is attachable to the axially outer end of the axially outer portion of the first housing via a handle weight attached directly to the axially outer portion of the first housing.

15. The adjustable weight lifting device as set forth in claim 11, further comprising means for preventing axial movement of the first weight disk relative to the axially outer portion of the first housing.

16. The adjustable weight lifting device as set forth in claim 15, wherein the means for preventing axial movement of the first weight disk relative to the axially outer portion of the first housing comprises a tongue and groove joint.

17. The adjustable weight lifting device as set forth in claim 16, further comprising a second weight disk adapted to be positioned adjacent to the first weight disk and having a component of the tongue and groove joint adapted to mate with a mating component of the tongue and groove joint on the first weight disk to prevent axial movement of the second weight disk relative to the first weight disk, the first pin being adapted to be axially moved and receivable in a hole in the second weight disk such that radial movement of the second weight disk relative to the first weight disk is prevented.

* * * * *